US011853001B2

(12) United States Patent
Ushikubo et al.

(10) Patent No.: US 11,853,001 B2
(45) Date of Patent: Dec. 26, 2023

(54) DEVELOPMENT DEVICE AND IMAGE FORMATION APPARATUS

(71) Applicant: Oki Electric Industry Co., Ltd., Tokyo (JP)

(72) Inventors: Junichi Ushikubo, Tokyo (JP); Yuuki Kobayashi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 18/054,151

(22) Filed: Nov. 10, 2022

(65) Prior Publication Data

US 2023/0176520 A1 Jun. 8, 2023

(30) Foreign Application Priority Data

Dec. 8, 2021 (JP) ..... 2021-199493

(51) Int. Cl.
*G03G 21/16* (2006.01)
*G03G 21/18* (2006.01)
*G03G 15/09* (2006.01)

(52) U.S. Cl.
CPC ..... *G03G 21/1842* (2013.01); *G03G 15/0921* (2013.01); *G03G 21/1647* (2013.01); *G03G 21/1676* (2013.01); *G03G 21/1814* (2013.01); *G03G 21/1821* (2013.01)

(58) Field of Classification Search
CPC ..... G03G 15/0877; G03G 15/0896; G03G 15/0921; G03G 21/1647; G03G 21/1676; G03G 21/1814; G03G 21/1821; G03G 21/1842
See application file for complete search history.

(56) References Cited

U.S. PATENT DOCUMENTS 11,709,438 B2 * 7/2023 Hamada ..... G03G 21/1814 399/222
2021/0149333 A1 * 5/2021 Sato ..... G03G 21/1821

FOREIGN PATENT DOCUMENTS

JP 2021-96422 A 6/2021

* cited by examiner

*Primary Examiner* — Sophia S Chen
(74) *Attorney, Agent, or Firm* — METROLEX IP LAW GROUP, PLLC

(57) ABSTRACT

A development device may include: a development device body; a developer cartridge detachably attached to the development device body; first and second levers provided to the development device body, the first lever including an operation part and a first engagement portion and the second lever including a second engagement portion; first and second engaged portions provided to the developer cartridge, the first engaged portion being configured to form a first engagement with the first engagement portion and the second engaged portion being configured to form a second engagement with the second engagement portion; and a first biasing member biasing the first engagement portion to the first engaged portion. When the operation part is operated with a first pressing force, the first engagement is released, and when the operation part is operated with a second pressing force greater than the first pressing force, the first and second engagements are released.

12 Claims, 17 Drawing Sheets

FIS

DEVELOPMENT DEVICE AND IMAGE FORMATION APPARATUS

CROSS REFERENCE TO RELATED APPLICATIONS

This application claims priority based on 35 USC 119 from prior Japanese Patent Application No. 2021-199493 filed on Dec. 8, 2021, entitled "DEVELOPMENT DEVICE AND IMAGE FORMATION APPARATUS", the entire contents of which are incorporated herein by reference.

BACKGROUND

This disclosure may relate to a development device and an image formation apparatus.

In a related art, a developer cartridge contains developer to be supplied to a development device of an image formation apparatus and is removable from and attachable to the development device.

In a case of a development device in which a developer cartridge is detachable from a development device body of the development device and the development device is detachable from an image formation apparatus, a fixing mechanism is provided to prevent the developer cartridge from coming off the development device body (see Patent Document 1).

Patent Document 1: Japanese Patent Application Publication No. 2021-096422

SUMMARY

However, in such a development device, the development device body and the developer cartridge could be unintentionally detached from each other and contaminate the inside and outside of the printer.

An object of an embodiment of the disclosure may be to provide a development device capable of preventing a developer cartridge from being unintentionally detached from a development device body.

An aspect of the disclosure may be a development device that may include: a development device body including a developer carrier; a developer cartridge configured to be attachable to and detachable from the development device body; a first lever and a second layer that are provided to the development device body, wherein the first lever includes an operation part and a first engagement portion and a second lever includes a second engagement portion; a first engaged portion and a second engaged portion that are provided to the developer cartridge, wherein the first engaged portion is configured to form a first engagement with the first engagement portion of the first lever and the second engaged portion is configured to form a second engagement with the second engagement portion of the second lever; and a first biasing member biasing the first engagement portion to the first engaged portion with a biasing force of the first biasing member. When the operation part of the first lever is operated with a first pressing force, the first engagement is released. When the operation part is operated with a second pressing force greater than the first pressing force, the first engagement is released and the second engagement is released by the second pressing force being transmitted from first lever to the second lever.

According to the above aspect, it may be possible to prevent the development device body and the toner cartridge from being unintentionally detached from each other outside the image formation apparatus.

DETAILED DESCRIPTION

Figure 1:
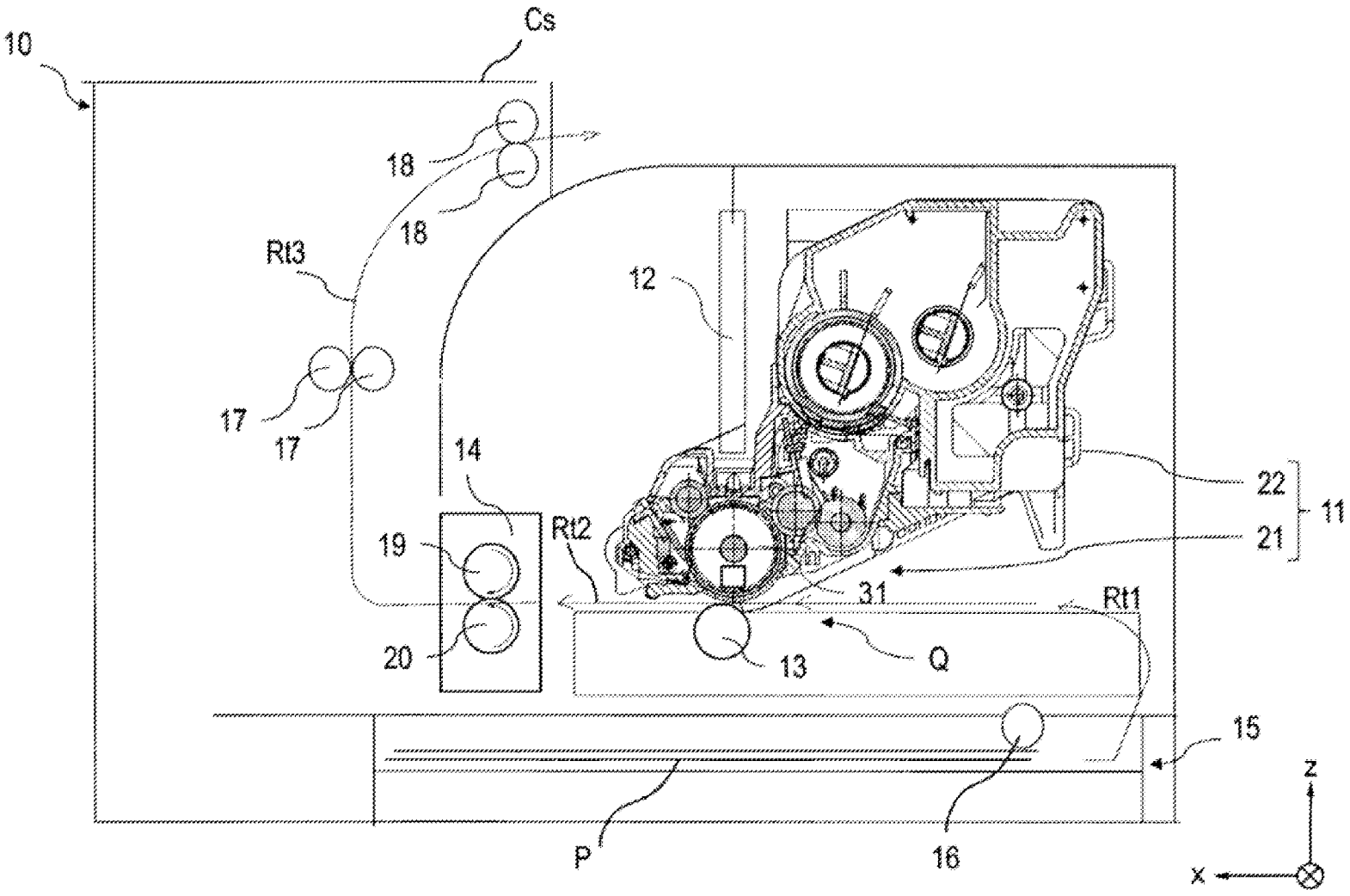
FIG. 1 is a diagram illustrating a conceptual view of a printer according to an embodiment of the disclosure.

Descriptions are provided hereinbelow for one or more embodiments based on the drawings. In the respective drawings referenced herein, the same constituents are designated by the same reference numerals and duplicate explanation concerning the same constituents is omitted. All of the drawings are provided to illustrate the respective examples only. Here, a development device 11 and a printer 10 as an image formation apparatus are described.

FIG. 1 is a diagram illustrating a conceptual diagram of the printer 10 according to an embodiment of the disclosure. The printer 10 includes a housing Cs of the printer 10, the development device 11, an LED head 12, a transfer roller 13, and a fixation device 14, and is a device for forming images. A paper feed cassette 15 is disposed below the housing Cs as a media storage section. Sheets of paper P as media are stacked and stored in the paper feed cassette 15. Then, a paper feed mechanism including a paper feed roller 16 is located adjacent to the paper feed cassette 15, and the sheets of paper P are separated one sheet at a time by the paper feed roller 16, and then the sheet of paper P is fed into the sheet conveyance path as a media conveyance path. The sheet of paper P fed in the Rt1 direction by the paper feed mechanism is fed to an image formation section Q. The image formation section Q includes the development device 11, the LED head 12, and the transfer roller 13, and image formation is performed by the image formation section Q.

In the drawing, the horizontal direction is the X-axis, and a later described direction in which the sheets of paper are conveyed from downstream of the image formation section Q to the fixation device 14, as illustrated in FIG. 1, is assumed to be a positive direction. The vertical upward direction is a positive direction of the Z-axis, and a width direction (main scanning direction) of the paper which is vertical to both of the X-axis and the Y-axis, that is the right side of the printer 10 from the negative side of the X-axis, is assumed to be a positive side of the Y-axis. The Y-axis direction is also referred to as the first direction in the following.

The LED head 12 is disposed so as to face above a photosensitive drum 31 included in the development device 11. The development device 11 extends in the Y-axis direction as its longitudinal direction and is freely inserted and removed from the housing Cs. The LED head 12 exposes the surface of the photosensitive drum 31 to form an electrostatic latent image based on print data.

Here, the photosensitive drum 31 is an organic photoreceptor formed by sequentially stacking a charge generation layer and a charge transport layer as photoconductive layers on a conductive support made of an aluminum metal pipe.

The transfer roller 13 is disposed so as to face downward from the photosensitive drum 31. A toner image formed on the photosensitive drum 31 is transferred, by the transfer roller 13, to the sheet of paper P fed between the photosensitive drum 31 and the transfer roller 13.

The sheet of paper P is then conveyed along the sheet conveyance path in the direction of Rt2 and sent to the fixation device 14. In the fixation device 14, the toner image on the paper P heated by a heating roller 19 is pressurized by a pressure roller 20 and fixed to the sheet of paper P by the pressure roller 20 to form an image on the paper P.

The sheet of paper P discharged from the fixation device 14 is conveyed by a conveyance roller 17 as a conveyance member in the Rt3 direction and is discharged out of the housing Cs by a paper discharge roller 18.

Figure 2B:
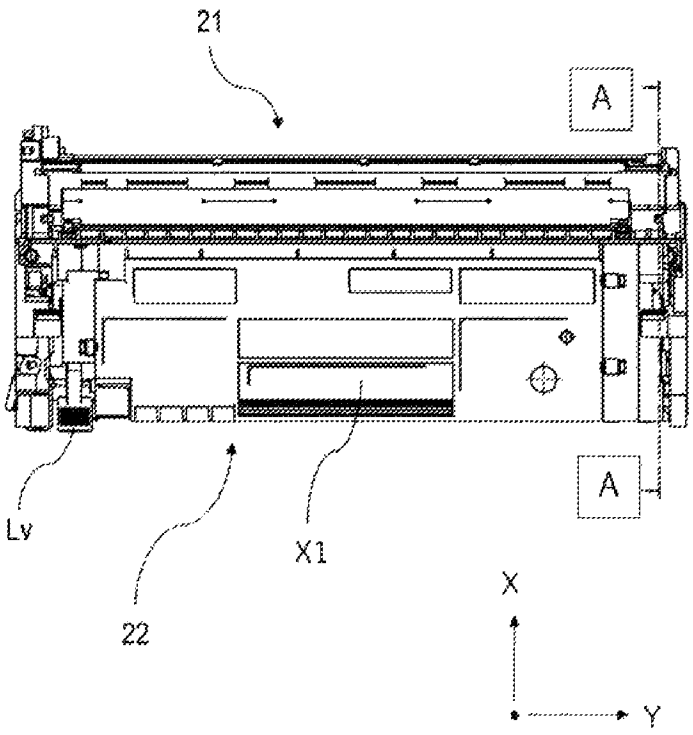
FIGS. 2A and 2B are diagrams illustrating an external view and a plan view of a development device 11 according to an embodiment of the disclosure.
Figure 2A:
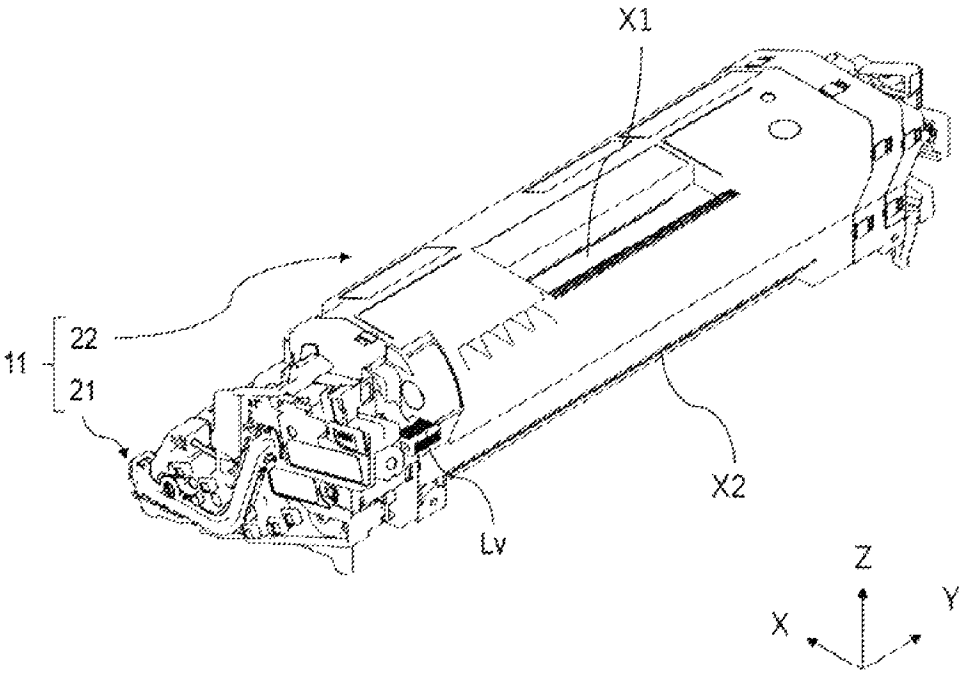

FIG. 2A is a diagram illustrating an external view of the development device 11 according to an embodiment, and FIG. 2B is a diagram illustrating a plan view of the development device 11 according to an embodiment. The development device 11 includes a development device body 21 (a development device main part 21) and a toner cartridge 22, which is detachable from the development device body 21. The development device body 21 accepts unused toner as a developer (hereinafter may be simply referred to as "toner") from the toner cartridge 22. The development device 11 is inserted into or removed from the printer 10 by a user grabbing and pulling handles X1 and X2 (grip portions) provided on the negative X-axis side of the toner cartridge 22. The toner cartridge 22 can be attached to and detached from the development device body 21 by grabbing and pulling the handles X1 and X2 by the user.

Figure 3:
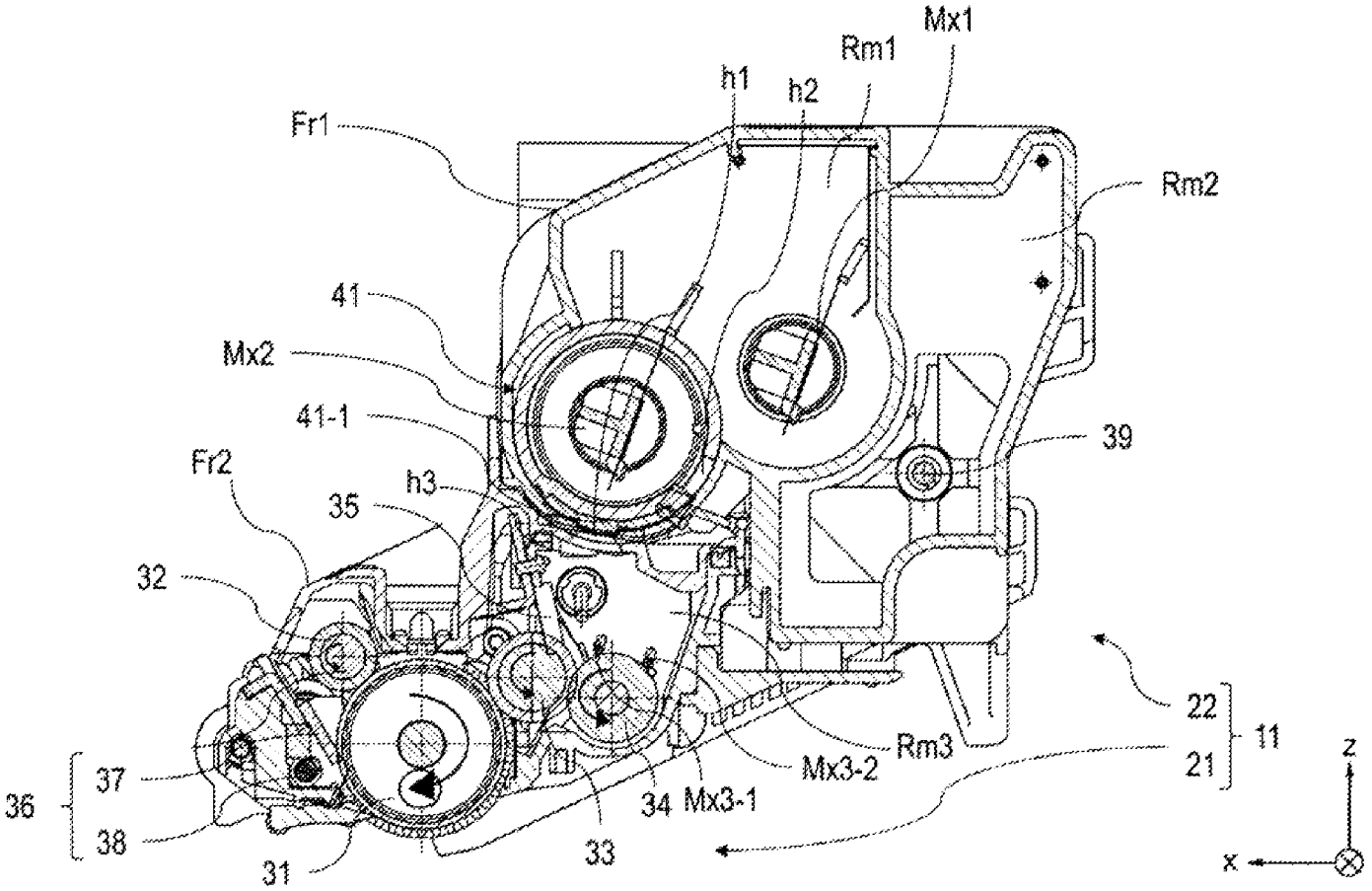
FIG. 3 is a diagram illustrating a cross-sectional view of the development device 11 according to an embodiment of the disclosure.

FIG. 3 is a diagram illustrating a cross-sectional view of the development device 11.

The toner cartridge 22 includes an outer frame Fr1 that includes inside therein a toner storage section Rm1 that holds toner, a waste toner storage section Rm2 that holds waste toner as waste developer, and a shutter unit 41. At the bottom of the toner storage section Rm1, that is, at the bottom of the outer frame Fr1 according to an embodiment, a toner discharge port h1 as a discharge port is formed, and the shutter unit 41 opens and closes the toner discharge port h1 according to an operation on a shutter lever Lv (FIGS. 2A and 2B). In the waste toner storage section Rm2, a collection spiral 39 for collecting waste toner is freely rotatable. Here, inside the toner storage section Rm1 and the shutter unit 41, respectively, stirring members Mx1 and Mx2 are freely rotatable.

The development device body 21 is formed extending in the Y-axis direction, and includes a base frame Fr2 including therein each element for the image formation process. The base frame Fr2 of the development device body 21 includes a toner supply port h3 as a supply port to receive toner supplied (discharged) from the toner discharge port h1 of the toner cartridge 22 and a toner storage section Rm3 as a developer storage section to store toner supplied from the toner supply port h3.

The elements housed inside the development device body 21 are the photosensitive drum 31, a charging roller 32 that uniformly charges the surface of the photosensitive drum 31, a development roller 33 that holds toner, and a supply roller 34 that supplies toner to the development roller 33, a development blade 35 that uniformly thins the toner supplied on the developer roller 33, a cleaning blade 37 that constitutes a cleaning unit 36, and a spiral 38 that conveys waste toner scraped off by the cleaning blade 37. In addition, stirring members Mx3-1 and Mx3-2, which stir the toner in the toner storage section Rm3, are disposed.

The photosensitive drum 31, the charging roller 32, the development roller 33, supply roller 34, and the like are connected to an unillustrated drive motor (drum motor), as a drive for image forming, and are rotated by the drive motor.

Figure 4:
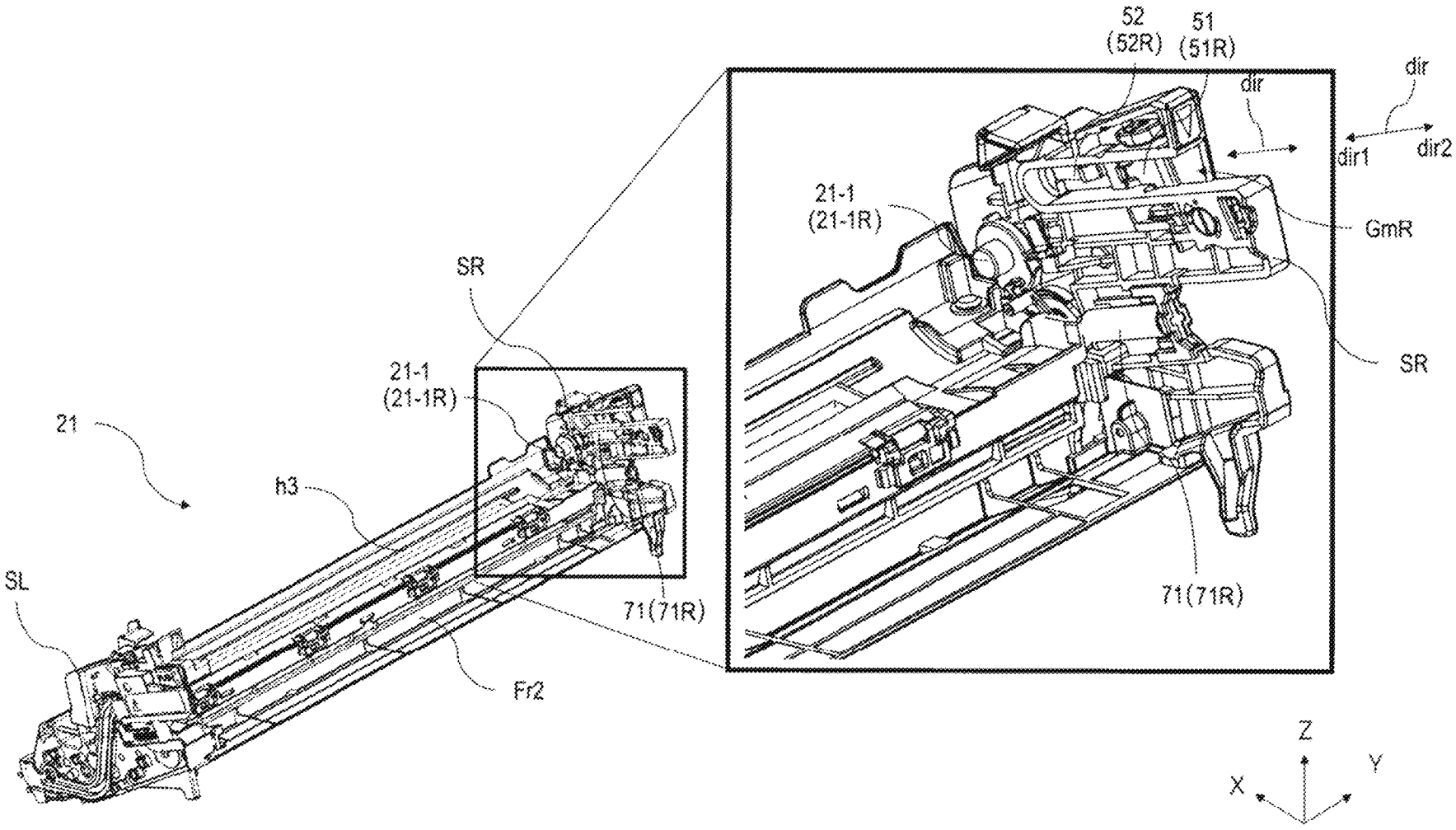
FIG. 4 is a diagram illustrating an external perspective view of a development device body 21 according to an embodiment of the disclosure.
Figure 5:
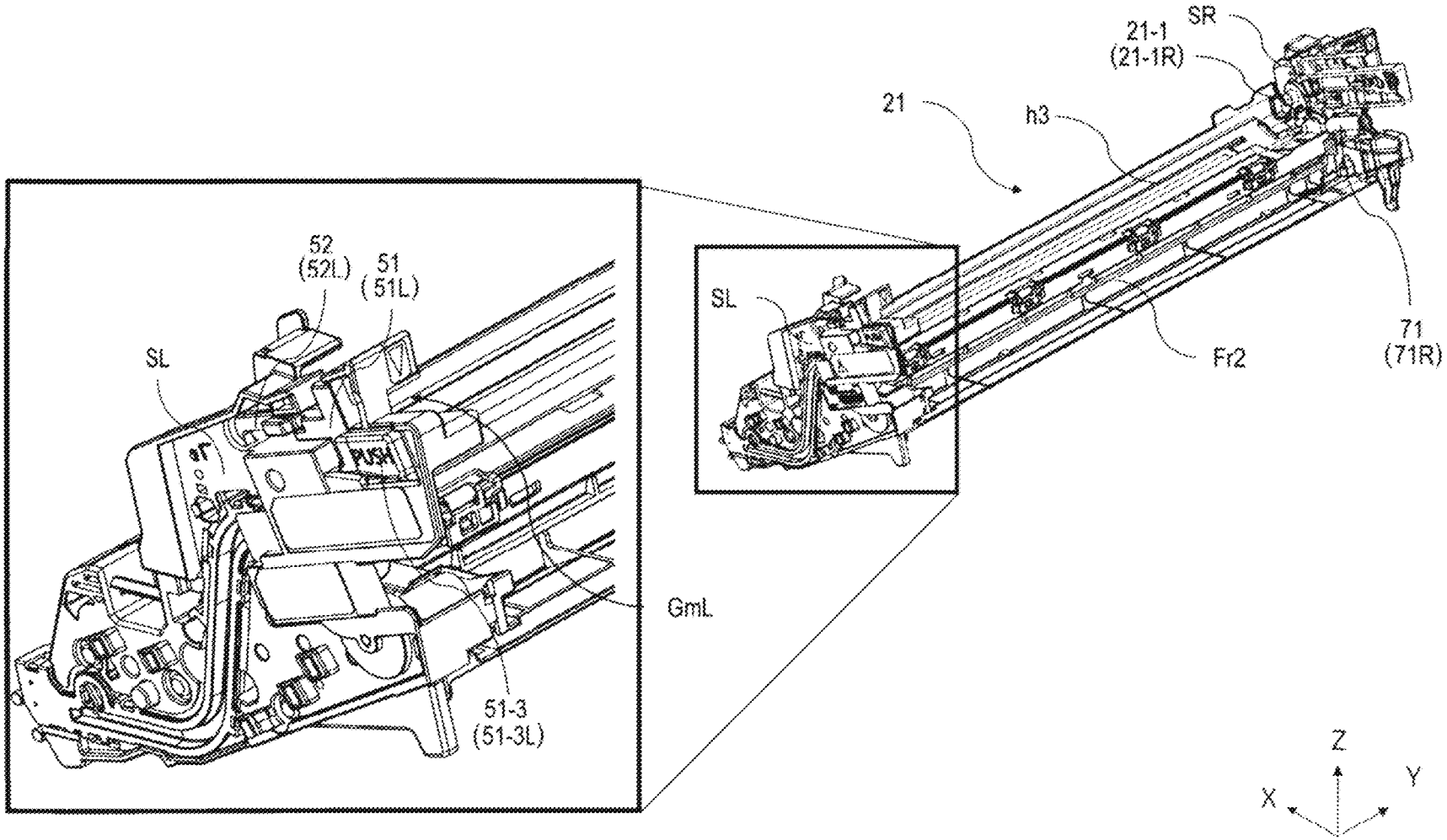
FIG. 5 is a diagram illustrating an external perspective view of the development device body 21 according to an embodiment of the disclosure.

FIGS. 4 and 5 are diagrams illustrating external perspective views of the development device body 21 according to an embodiment. FIG. 4 includes an enlarged view of the right side end of the development device body 21 when viewed from the negative X-axis side, and FIG. 5 includes an enlarged view of the left side end.

The development device body 21 includes side plates SL and SR respectively formed at one end and the other end of the base frame Fr2 in the Y-axis direction. Inside the side plates SL and SR, respectively, the attachment/detachment guides GmL and GmR that guide the attachment/detachment of the toner cartridge 22 are formed. The attachment/detachment guides GmL and GmR are recesses from the inside to the outside of the development device body 21 in the Y-axis direction, and extend in the attaching/detaching direction dir of the toner cartridge 22. The attachment/detachment guides GmL and GmR have symmetrical structures.

The inside of the development device body 21 in the Y-axis direction means, for example, the positive side of the Y-axis on the left side plate SL side, and the negative side of the Y-axis on the right side plate SR side.

In the following, the direction in which the toner cartridge 22 is attached to the development device body 21 is referred to as an attaching direction dir1, and the direction in which the cartridge is detached from the development device body 21 is referred to as a detaching direction dir2.

Inside the left and right side plates SL and SR, left and right posts 21-1 are provided such that the posts protrude from the left and right side plates SL and SR in the Y-axis direction toward the inside of the development device body 21 on the side of the attachment/detachment guides GmL and GmR, in the attaching direction dir1. Note that only right post 21-1R of the posts 21-1 is illustrated in FIGS. 4 and 5.

According to the embodiment, the development device body 21 includes at both ends in the Y-axis direction respectively, first springs 71 that press the outer frames Fr1 of the toner cartridge 22 toward the detaching direction dir2. Note that only one 71R of the first springs 71 that is provided on the side of the right side plate SR is illustrated in FIGS. 4 and 5.

The side plates SL, SR respectively extend from the base frame Fr2 to the detachment direction dir2 side toward a first direction orthogonal to the attaching/detaching direction dir (Y-axis direction), at outer sides of the development device 11. The side plate SL includes a first lever 51L and a second lever 52L that fix the position of the toner cartridge 22 with respect to the development device body 21 and are provided swingably with respect to the side plate SL. The side plate SR side has a symmetrical structure, and a first lever 51R and a second lever 52R are provided swingably with respect to the side plate SR. The side plates SL and SR serve as support parts that support (hold) the first lever 51 and the second lever 52.

Figure 6:
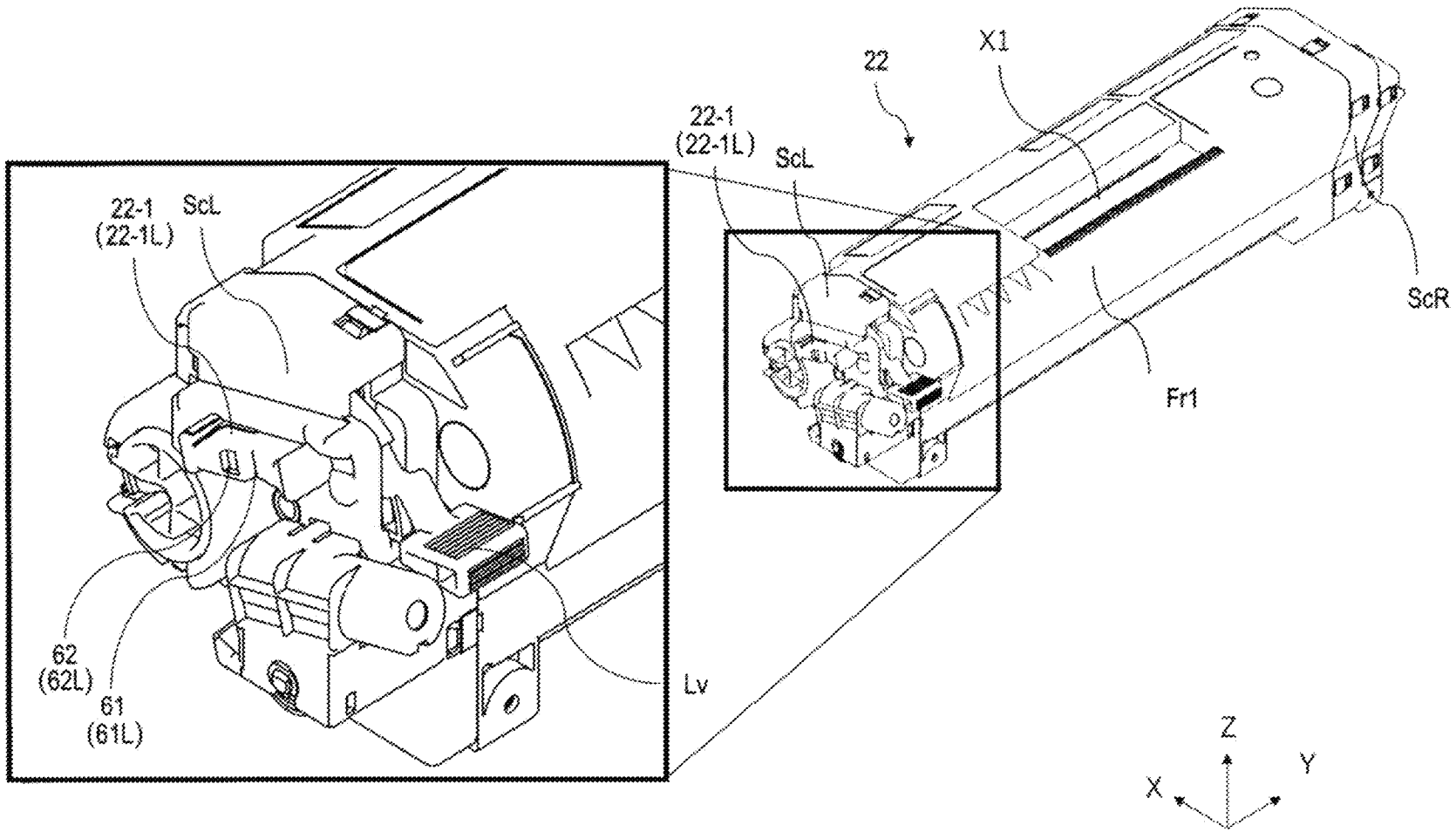
FIG. 6 is a diagram illustrating an external perspective view of a toner cartridge 22 according to an embodiment of the disclosure.

FIG. 6 is a diagram illustrating an external perspective view of the toner cartridge 22 according to an embodiment. The toner cartridge 22 is composed of a bottomed outer frame Fr1 extending in the Y-axis direction and side covers ScL and ScR respectively covering one end and the other end of the outer frame Fr1 in the Y-axis direction. The shutter lever Lv is installed between the side cover ScL and the outer frame Fr1, and the shutter lever Lv is arranged to freely swing with respect to the outer frame Fr1. On the sides of the side covers ScL and ScR, attachment/detachment guided portions 22-1 protruding toward outside of the toner cartridge 22 in the Y-axis direction are respectively provided. Note that only one 22-1L of the attachment/detachment guided portions 22-1 that is provided on the side of the left side cover ScL is illustrated in FIG. 6.

The attachment/detachment guided portions 22-1R and 22-1L respectively move within the attachment/detachment guides GmL, GmR respectively, when attaching or detaching the toner cartridge 22. This allows the toner cartridge 22 to be guided by the attachment/detachment guides GmL and GmR to move in the attaching/detaching direction dir. In addition, the attachment/detachment guided portions 22-1L and 22-1R include a first recess 61 as a first engaged portion to be engaged with the first lever 51 and a second recess 62 as a second engaged portion to be engaged with the second lever 52 when the developer device 11 is outside of the printer 10 and the toner cartridge 22 is mounted to the development device body 21. In the following, the engagement between the first lever 51 and the first recess 61 is referred to as a first engagement, the engagement between the second lever 52 and the second recess 62 is referred to as a second engagement. The specific structure is described below.

Figure 7:
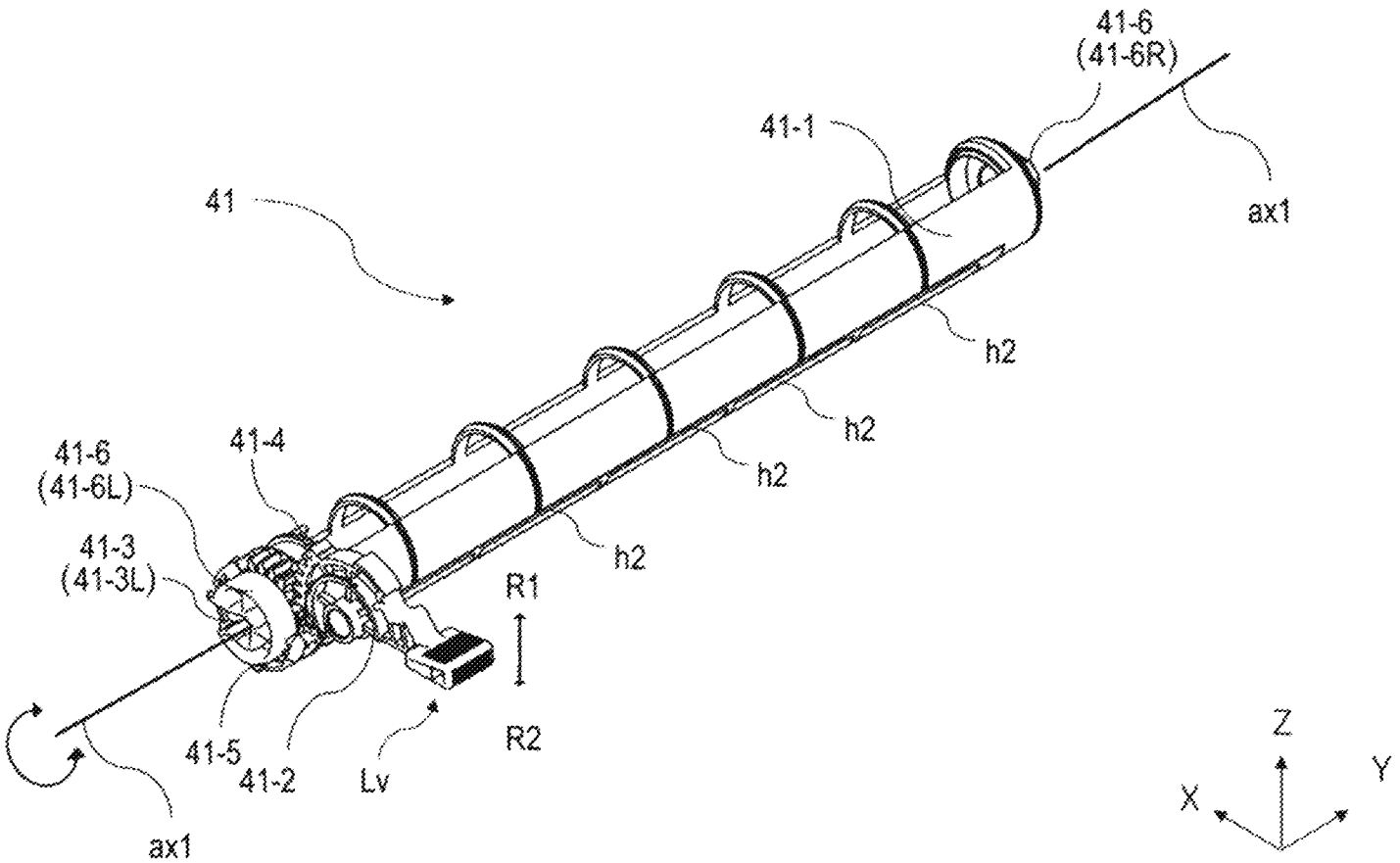
FIG. 7 is a diagram illustrating an external perspective view of a shutter unit 41 according to an embodiment of the disclosure.

FIG. 7 is a diagram illustrating an external perspective view of the shutter unit 41 according to an embodiment. The shutter unit 41 is composed of a shutter member 41-1 and a lever member 41-2. Pinion gears 41-4 and 41-5 provided to the shutter member 41-1 and lever member 41-2 respectively are engaged. The lever member 41-2 includes the shutter lever Lv. The shutter member 41-1 is arranged extending in the Y-axis direction and is rotatable about a rotation axis ax1, that is about the Y-axis when the shutter lever Lv is operated.

FIG. 7 illustrates the shutter member 41-1 is in a closed position where the shutter opening h2 of the shutter member 41-1 does not overlap the toner discharge port h1 (FIG. 3) of the toner cartridge 22, that is, the shutter member 41-1 closes the toner discharge port h1 (FIG. 3) of the toner cartridge 22 as illustrated in FIG. 3. When the shutter member 41-1 is in the closed position, as illustrated in FIG. 3, the shutter member 41-1 closes the toner discharge port h1 (FIG. 3) of the toner cartridge 22 and stops the toner supply from the toner storage section Rm1 (FIG. 3) of the toner cartridge 22 to the toner storage section Rm3 (FIG. 3) of the development device body 21.

When the shutter lever Lv of the toner cartridge 22 is operated by pressing toward an R1 direction in a state where the shutter member 41-1 is in the closed position, the lever member 41-2 is rotated counterclockwise as viewed from the negative side of the Y-axis, a pressing force is transmitted to the shutter member 41-1 through the pinion gears 41-4 and 41-5, and thus the shutter member 41-1 rotates clockwise as viewed from the negative side of the Y-axis. With this operation, the shutter opening h2 of the shutter member 41-1 moves to an open position so that the shutter opening h2 overlap the toner discharge port h1 of the toner cartridge 22, so as to allow toner supply from the toner storage section Rm1 (FIG. 3) of the toner cartridge 22 to the toner storage section Rm3 (FIG. 3) of the development device body 2.

To the contrary, when the shutter lever Lv of the toner cartridge 22 is pressed toward an R2 direction in a state that the shutter unit 41 (the shutter member 41-1) is in the open position, the lever member 41-2 is rotated clockwise, and the shutter member 41-1 moves to the closed position.

Further, at both ends of the shutter member 41-1 in the Y-axis direction, U-shaped members 41-6L and 41-6R are provided respectively. When the toner cartridge 22 is mounted to the development device body 21, the U-shaped members 41-6L and 41-6R respectively engage with the posts 21-1 (FIG. 4) of the development device body 21. The specific operation will be explained later referring to FIGS. 8A and 8B.

Next, with reference to FIG. 3, the operation of toner supply and image formation inside the development device 11 is described below.

As mentioned above, when the shutter member 41-1 of the toner cartridge 22 is moved from the closed position where the shutter member 41-1 closes the toner discharge port h1 of the toner cartridge 22 as illustrated in FIG. 3 to the open position where the shutter opening h2 (FIG. 7) of the shutter unit 41 (the shutter member 41-1) overlaps the toner discharge port h1 of the toner cartridge 22, the toner contained in the toner storage section Rm1 is discharged from the toner discharge port h1 via the shutter opening h2 of the shutter unit 41 (the shutter member 41-1) and thus supplied to the toner storage section Rm3 of the development device body 21 via the toner supply port h3 of the development device body 21.

In FIG. 3, when the development roller 33 and supply roller 34 are rotated counterclockwise by the drive motor, the toner frictionally charged by the supply roller 34 is supplied to the development roller 33. The toner supplied to the development roller 33 is then sent to a contact area between the development roller 33 and the development blade 35 according to the rotation of the development roller 33 and is made into a thin layer by the development blade 35.

The photosensitive drum 31 is rotated clockwise in FIG. 3 by the drive motor, and the charging roller 32 is rotated counterclockwise in a companion rotation. When the surface of the photosensitive drum 31 is then uniformly charged by the charging roller 32, the photosensitive drum 31 is exposed by the LED head 12 (FIG. 1) to form an electrostatic latent image on the surface. The toner on the development roller 33 is then electrostatically adhered to the electrostatic latent image to form a toner image. The toner image on the photosensitive drum 31 is then transferred to the sheet of paper P by the transfer roller 13 (FIG. 1).

The toner remaining on the surface of the photosensitive drum 31 after the transfer of the toner image is scraped off by the cleaning blade 37 as the photosensitive drum 31 rotates, and falls to the bottom of a cleaning unit 36, where the toner is collected as waste toner by the rotation of the spiral 38 in the waste toner storage section Rm2.

Figure 8B:
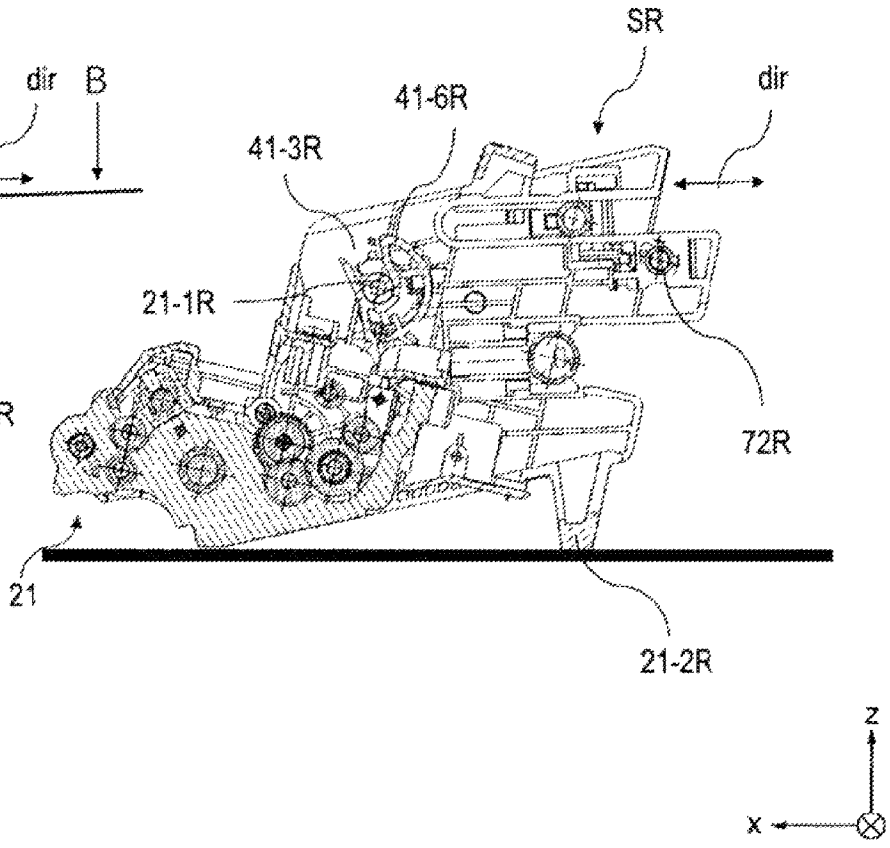
FIGS. 8A and 8B are diagrams illustrating the development device 11 in a non-fixed state and a fixed state based on an operation of a shutter lever Lv in a case where the development device 11 is placed on a horizontal plane, according to an embodiment of the disclosure.
Figure 8A:
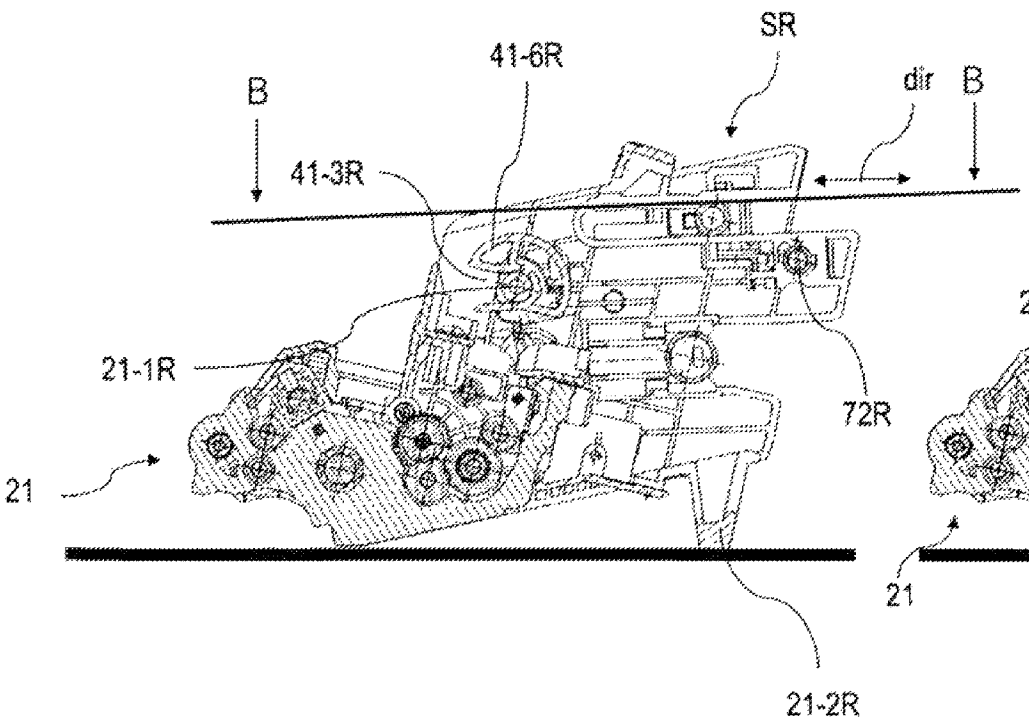

FIGS. 8A and 8B are diagrams illustrating the development device 11 in a non-fixed state and a fixed state based on the operation of the shutter lever Lv in a case where the development device 11 is placed on a horizontal plane. Specifically, the diagrams are the A-A arrow view in FIG. 2B. FIG. 8A illustrates a state that the toner cartridge 22 is separable (detachable) from the development device body 21. At this time, the shutter member 41-1 (FIG. 7) of the toner cartridge 22 is in the closed position. FIG. 8B illustrates a state that the toner cartridge 22 is fixed to the development device body 21. At this time, the shutter member 41-1 (FIG. 7) the toner cartridge 22 is in the open position. When the development device 11 or the development device body 21 is placed on a horizontal surface, since legs 21-2R and 21-2L provided to both side plates SR and SL prevent the development device 11 or the development device body 21 from tipping over, the development device 11 or the development device body 21 can be placed stably as illustrated in FIGS. 8A and 8B. In this case, the length of the legs 21-2R and 21-2L are set (adjusted) so that the attaching/detaching direction dir is in an abbreviated horizontal direction. Note that FIGS. 8A and 8B illustrate the side plate SR side of the development device 11. The left side plate SL side of the development device 11 has the symmetrical structure with respect to the right side plate SR side.

FIG. 8A illustrates a state that the toner cartridge 22 is inserted in the development device body 21 and posts 21-1L and 21-1R respectively provided to the side plates SL and SR of the development device body 21 are respectively inserted into engaging/fixing grooves 41-3L and 41-3R provided to the U-shaped members 41-6L and 41-6R of the shutter member 41-1 of the toner cartridge 22. Then, FIG. 8B illustrates a state where the U-shaped members 41-6L and 41-6R of the toner cartridge 22 and the posts 21-1L and 21-1R of the development device body 21 are respectively engaged, by operating the shutter lever Lv (FIG. 7) of the toner cartridge 22 to rotate the shutter member 41-1 (FIG. 7) from the closed position to the open position. In FIG. 8B, since the attaching/detaching direction dir and the direction of extension of the engaging/fixing groove 41-3R intersect, the relative positions of the toner cartridge 22 and the development device body 21 can be fixed in a state where the toner cartridge 22 can supply toner from the toner cartridge 22 to the development device body 21. In the following, an engagement between the U-shaped member 41-6L and the post 21-1L and an engagement between the U-shaped member 41-6R and the post 21-1R are referred to as third engagements.

On the other hand, by operating the shutter lever Lv (FIG. 7) in a state where the toner cartridge 22 is fixed to the development device body 21 by the third engagements as illustrated in FIG. 8B, to rotate the shutter member 41-1 (FIG. 7) of the toner cartridge 22 to the closed position, while the posts 21-1L and 21-1R of the development device body 21 are being inserted in the engaging/fixing grooves 41-3L and 41-3R of the toner cartridge 22, the state becomes as illustrated in FIG. 8A. In the state illustrated in FIG. 8A, since the direction of attaching/detaching direction dir and the extending direction of the engaging/fixing grooves are substantially parallel, the toner cartridge 22 can be detached from the development device body 21 in a state where the toner cannot be supplied from the toner cartridge 22 to the development device body 21. In other words, the third engagements are released.

As described above, when the toner cartridge 22 is gripped and pulled out in the detaching direction in a state that the third engagements are formed by operating the above shutter lever Lv, the development device 11 including the toner cartridge 22 and the development device body 21 being engaged with each other is detached from the printer 10.

On the other hand, when the toner cartridge 22 is gripped and pulled out in a state that the third engagements are released by operating the shutter lever Lv, the toner cartridge 22 is detached from the development device body 21.

Figure 9:
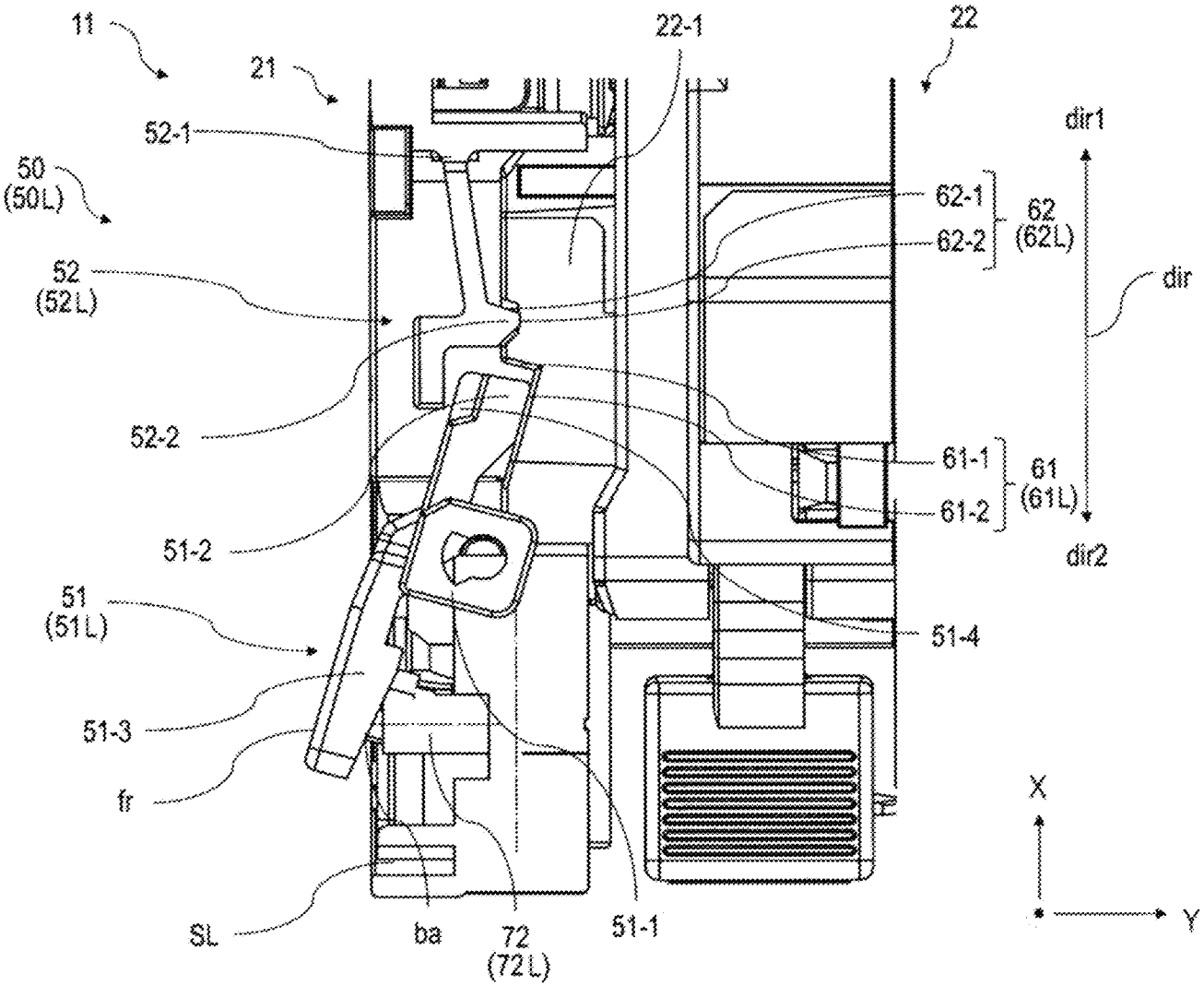
FIG. 9 is a diagram illustrating a view of a lock mechanism 50 (50L) on a let side plate SL side as seen from a positive direction of the Z-axis according to an embodiment of the disclosure.
Figure 10B:
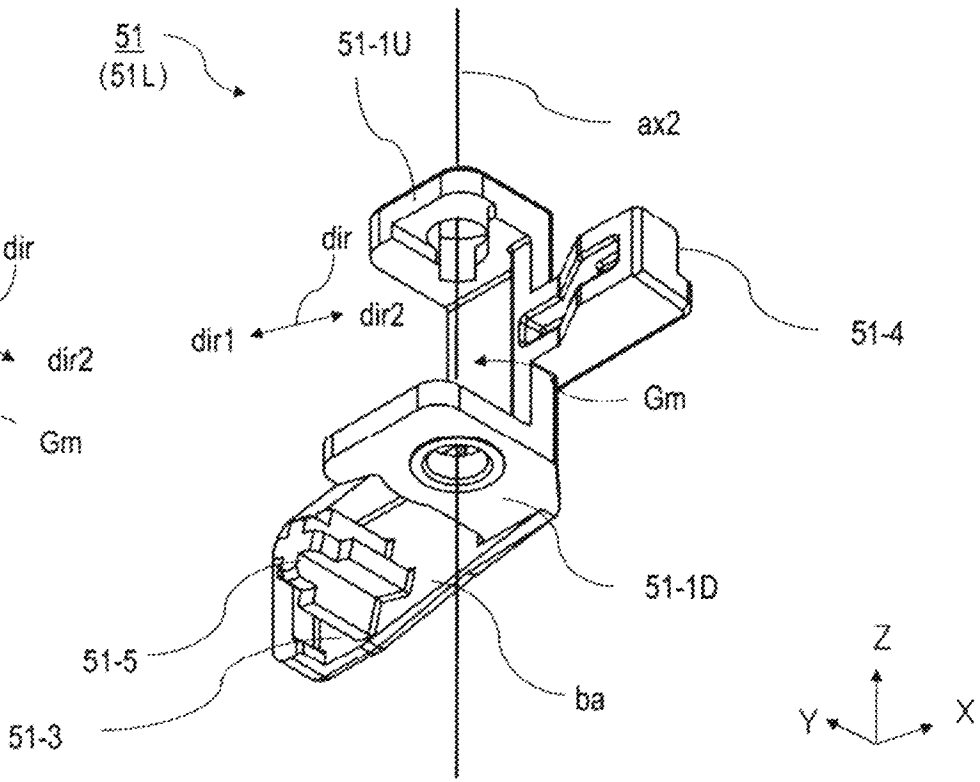
FIGS. 10A and 10B are both diagrams illustrating external perspective views of a first lever 51 (51L) on the side of the left side plate SL according to an embodiment of the disclosure.
Figure 10A:
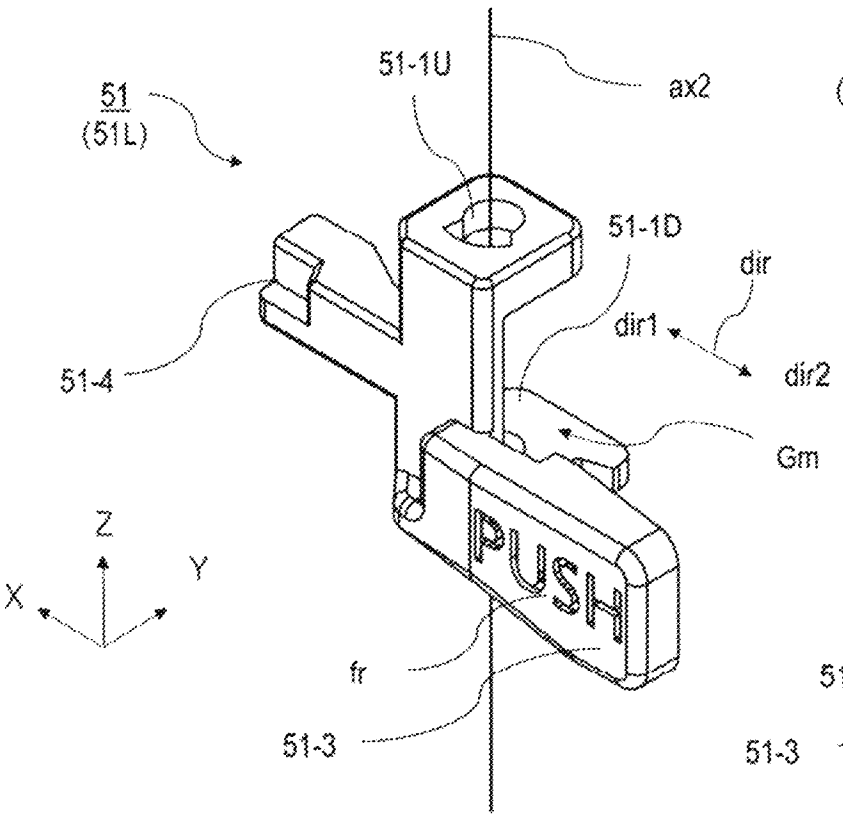

FIG. 9 is a diagram illustrating a view of a lock mechanism 50 (50L) on the left side plate SL side as seen from the positive direction of the Z-axis. FIGS. 10A and 10B are both diagrams illustrating external perspective views of the first lever 51 (51L) on the side of the side plate SL. The lock mechanism 50 (50L) is composed of the first lever 51 (51L), the second lever 52 (52L), a first engaged portion 61 (61L), a second engaged portion 62 (62L), and a second spring 72 (72L) described below. Since the lock mechanism 50 on the right side plate SR side has the symmetrical structure with respect to the lock mechanism 50 (50L) on the left side plate SL side, the engagement state of the lock mechanism 50 is described by partially omitting some of the references R and L that indicate right and left in the following descriptions and drawings of FIGS. 9 to 17.

The lock mechanism 50 is described with reference to FIGS. 9, 10A and 10B below. As mentioned above, the side plate SL of the development device body 21 is provided with the first lever 51 and the second lever 52. In an embodiment, the first lever 51 is a resinous member illustrated in FIGS. 10A and 10B that is attached to the side plate SL, and the second lever 52 is a resin member integrally formed with the side plate SL.

First, the first lever 51, the first recess 61, and the first engagement between the first lever 51 and the first recess 61 are explained below.

The first lever 51 is provided swingably, with respect to the side plate SL, about shaft support portions 51-1 as a first swing support portion. Specifically, the shaft support portions 51-1 are portions spaced apart from each other in the Z-axis direction and each of the shaft support portions 51-1 is formed with a hole. The shaft support portion 51-1 on the positive side in the Z-axis is designated by 51-1U and the shaft support portion 51-1 on the negative side in the Z-axis is designated by 51-1D. A post (not illustrated) provided to the side plate SL and extending in the positive direction of the Z-axis is inserted in the hole in each of the shaft support portions 51-1U and 51-1D and thus the first lever 51 is swingably supported about the post (the holes). The first lever 51 includes an operation part 51-3 provided on the detaching direction dir2 side of the shaft support portions 51-1, and a first protrusion portion 51-2 provided on the attaching direction dill side pf the shaft support portions 51-1, wherein the first protrusion portion functions as a first engagement portion configured to be engaged with the first recess 61. A reference sign "ax2" illustrated in FIGS. 10A and 10B designates an axis of the swing (a swing center) of the first lever 51. The shaft support portions 51-1 are spaced away from each other in the Z-axis direction, and the space between the shaft support portions 51-1 forms a part of the attachment/detachment guide Gm. A surface fr (outer surface fr) of the operation part 51-3 on an outer side of the development device 11 is configured to receive an operation of pressing by a user, while an inner surface ba of the operation part 51-3, which is provided on the opposite side of the outer surface fr, is pressed by the second spring 72 toward the outer side of the development device 11. The inner surface ba of the operation part 51-3 includes a second spring retaining section 51-5 that holds the second spring 72. By the biasing force applied by the second spring 72, the operation part 51-3 protrudes to the outside of the side plate SL.

The first recess 61 is a recess portion being concave in the Y-axis direction The first recess 61 includes a first engaged surface 61-1 that is provided on the attaching direction dir1 side than the first protrusion portion 51-2 an that faces the first protrusion portion 51-2 in the attaching/detaching direction dir and a first restriction surface 61-2 that is configured to restrict a rotation angle of the first protrusion portion 51-2, which is to be rotated by the biasing force of the second spring 72.

The first engagement represents the state in which the first protrusion portion 51-2 of the first lever 51 is in contact with the first restriction surface 61-2 of the first recess 61 with the first protrusion portion 51-2 of the first lever 51 facing the first engaged surface 61-1 of the first recess 61 in the attaching/detaching direction dir. In a state where the first engagement is formed, if the user tries to move the toner cartridge 22 with respect to the development device body 21 in the detaching direction dir1, the first protrusion portion 51-2 of the first lever 51 comes in contact with the first engaged surface 61-1, to thereby prevent the toner cartridge 22 from being detached from the development device body 21.

Next, the second lever 52, the second recess 62 and the second engagement between the second lever 52 and the second recess 62 are described below.

The second lever 52 extends from a second lever base portion 52-1 formed at the side plate SL as a second swing support of the second lever 52 toward the detaching direction dir2 side. That is, the second lever 52 is provided swingably with respect to the side plate SL about the second lever base portion 52-1. The second lever 52 includes, on the detaching direction dir2 side of the second lever base portion 52-1, a second protrusion portion 52-2 as the second engagement portion that is configured to engage with the second recess 62.

The second recess 62 is a recess portion being concave in the Y-axis direction. The second recess 62 includes a second engaged surface 62-1 that is provided on the attaching direction dir1 side than the second protrusion portion 52-2 and faces the second protrusion portion 52-2 in the attaching/detaching direction dir1, and a second restriction surface 62-2 that is configured to restrict a swing angle of the second protrusion portion 52-2 that is configured to swing about the second lever base portion 52-1.

The second engagement represents the state in which the second protrusion portion 52-2 of the second lever 52 is in contact with the second restriction surface 62-2 of the second recess 62 with the second protrusion portion 52-2 of the second lever 52 facing the second engaged surface 62-1 of the second recess 62 in the attaching/detaching direction dir. In the state in which the second engagement is formed, if the user tries to move the toner cartridge 22 with respect to the development device body 21 in the detaching direction dir1, the second protrusion portion 52-2 of the second lever 52 comes in contact with the second engaged surface 62-1, to thereby prevent the toner cartridge 22 from being detached from the development device body 21.

Furthermore, the first protrusion portion 51-2 of the first lever 51 includes a notch 51-4, and thus the first lever 51 and the second lever 52 are spaced apart in the Y-axis direction when the first engagement is formed.

Figure 11:
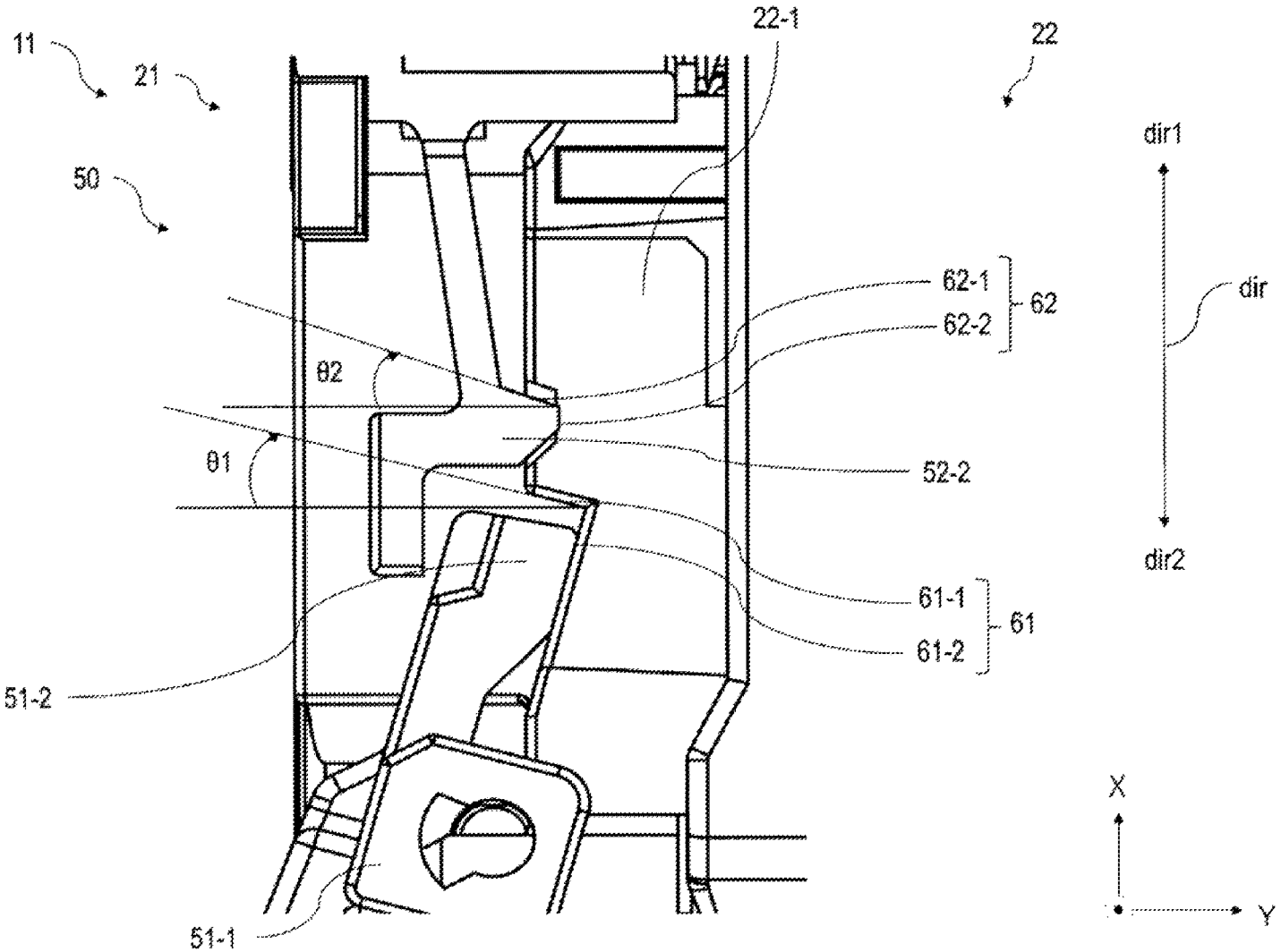
FIG. 11 is a diagram illustrating an enlarged view of the lock mechanism 50 according to an embodiment of the disclosure.

FIG. 11 is a diagram illustrating an enlarged view of the lock mechanism 50 according to an embodiment.

In an embodiment, the first engaged surface 61-1 and the second engaged surface 62-1 are inclined with respect to the Y axis toward the attaching direction dirt side as seen in the XY plane in FIG. 11. For example, on the left side plate SL side illustrated in FIG. 11, the angle 81 at which the first engaged surface 61-1 is inclined with respect to the negative direction of the Y-axis is 6 degrees smaller than the angle 82 at which the second engaged surface 62-1 is inclined with respect to the negative direction of the Y-axis. In other words, the inner angle 81 between the first engaged surface 61-1 and the Y-axis (a first direction) as seen from the outer side of the development device 11 (from the negative side of the Y-axis, from the right side in FIG. 11) is 6 degrees smaller than the inner angle 82 between the second engaged surface 62-1 and the Y-axis (the first direction) as seen from the outer side of the development device 11. In addition, the length of the second engaged surface 62-1 in the Y-axis direction is smaller than the length of the first engaged surface 61-1 in the Y-axis direction. With this configuration, the engagement force of the second engagement between the second lever 52 and the second recess 62 (the second engaged surface 62-1) is weaker than the engagement force of the first engagement between the first lever 51 and the first recess 61 (the first engaged surface 61-1).

Figure 12:
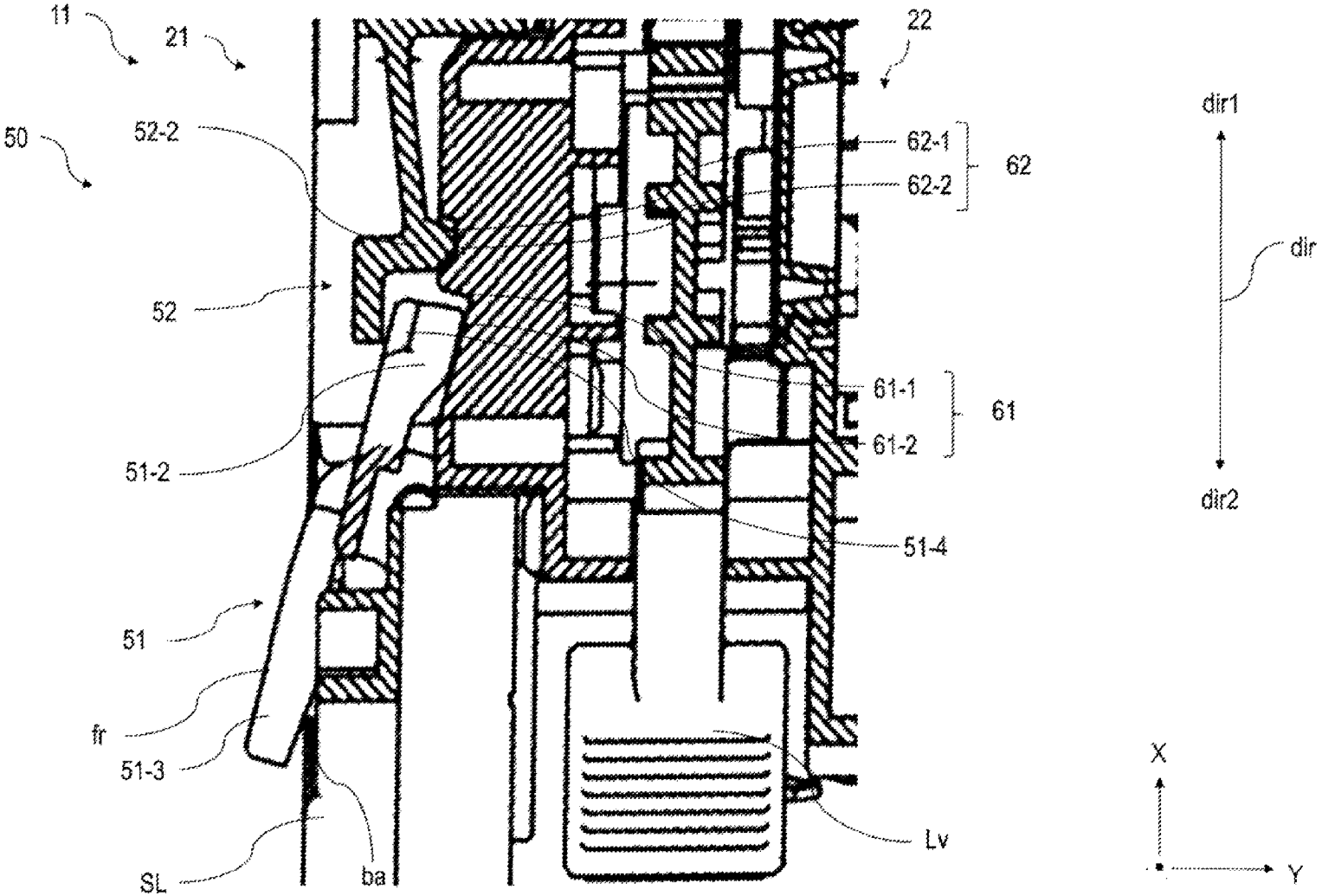
FIG. 12 is a diagram illustrating a cross-sectional view of the lock mechanism 50 according to an embodiment of the disclosure.

FIG. 12 is a cross-sectional view of the lock mechanism 50 according to an embodiment, illustrating a state in which both the first engagement and the second engagement are formed. Specifically, FIG. 12 is a cross sectional view taken along the B-B line in FIG. 8A. Note that FIGS. 12 to 15 and 17 all correspond to the B-B cross section in FIG. 8A.

As mentioned above, since the first engaged surface 61-1 faces the first protrusion portion 51-2 of the first lever 51 in the attaching/detaching direction dir in a state that when the first engagement is formed, when the user tries to pull out the toner cartridge 22 in the detaching direction dir2, the first engaged surface 61-1 comes in contact with the first protrusion portion 51-2 of the first lever 51 and restricts the detachment. When the toner cartridge 22 is mounted in the development device body 21 and the outer surface fr of the operation part 51-3 is not receiving a pressing force, since the inner surface ba receives a force by the second spring 72 (FIG. 9), the first lever 51 rotates and the first protrusion portion 51-2 of the first lever 51 remains in contact with the first restriction surface 61-2. This maintains the state in which the first engagement is formed, with the first engaged surface 61-1 facing the first protrusion portion 51-2 of the first lever 51 in the attaching/detaching direction dir. Therefore, the first engagement can be maintained as long as a certain amount of pressing force is not applied to the outer surface fr of the operation part 51-3. In the following, the pressing force on the outer surface fr which disengages the first engagement is referred to as a first pressing force, and the biasing force applied by the second spring 72 (FIG. 9) to the operation part 51-3 that makes the first protrusion portion 51-2 of the first lever 51 press the first recess 61 is referred to as a first biasing force.

The second lever 52 maintains its shape by its own elastic force. When the second engagement is formed with this configuration, the second protrusion portion 52-2 of the second lever 52 applies a force to the second recess 62. In the following, this biasing force is referred to as a second biasing force. The second engaged surface 62-1 faces the second protrusion portion 52-2 of the second lever 52 in the attaching/detaching direction dir, and the second engaged surface 62-1 comes in contact with the second protrusion portion 52-2 of the second lever 52 in the state where the second engagement is formed. This maintains the second engagement and thus restricts the detachment of the toner cartridge 22.

Here, it is configured that, since the second biasing force that the second protrusion portion 52-2 of the second lever 52 applies a force on the second recess 62 is smaller than the first biasing force that the first protrusion portion 51-2 of the first lever 51 applies a force on the first recess 61 since the second biasing force is applied by the second lever 52 using its elastic force.

Furthermore, since the toner cartridge 22 is attached to the development device body 21 outside of the printer 10 against the biasing force of the first spring 71 (FIG. 4) that biases the toner cartridge 22 toward the detaching direction dir2 with respect to the development device body 21, the second protrusion portion 52-2 of the second lever 52 is in contact with the second restriction surface 62-2 to thereby form the first engagement and the first protrusion portion 51-2 of the first lever 51 is in contact with the first restriction surface 61-2 to thereby form the second the second engagement. In this state, as illustrated in FIGS. 9 and 12, the second protrusion portion 52-2 of the second lever 52 is in contact with the second engaged surface 62-1 so as to restrict the detachment of the toner cartridge 22 from the development device body 21. Thus, the second engagement is formed to position the toner cartridge 22 relative to the development device body 21.

In the state the toner cartridge 22 is positioned relative to the development device body 21 by the second engagement, the first protrusion portion 51-2 of the first lever 51 is not in contact with the first engaged surface 61-1, as illustrated in FIGS. 9 and 12. This configuration can avoid deterioration of operability of the operation part 51-3 of the first lever 51 due to the friction between the first lever 51 and the first engaged surface 61-1.

Furthermore, since the first protrusion portion 51-2 of the first lever 51 includes a notch 51-4, the first protrusion portion 51-2 of the first lever 51 and the second protrusion portion 52-2 of the second lever 52 are spaced apart from each other in the state the first engagement is formed. With this configuration, after a certain amount of pressing force is applied by the user to the outer surface fr of the operation part 51-3 and the first lever 51 is rotated to disengage the first engagement, the first protrusion portion 51-2 of the first lever 51 and the second protrusion portion 52-2 of the second lever 52 come into contact with each other. Therefore, since the pressing force is not transmitted from the first lever 51 to the second lever 52 unless the first protrusion portion 51-2 of the first lever 51 and the second protrusion portion 52-2 of the second lever 52 come into contact, the second engagement can be maintained even when the first engagement is released. In the following, the pressing force on the outer surface fr that releases both the first engagement and the second engagement is referred to as a second pressing force.

The engagement force of the second engagement is set stronger than the biasing force of the first spring 71 (FIG. 4). For this purpose, the length of the second restriction surface 62-2 in the Y-axis direction is designed (adjusted). With this configuration, since the second engagement is not released by the biasing force of the first spring 71, the second engagement is maintained even if the user releases their hand after installing (attaching) the toner cartridge 22 to the development device body 21. This means that when installing (attaching) the toner cartridge 22 to the development device body 21, the operability is improved since the user dose no need to operate the shutter lever Lv with one hand while grabbing and pushing the handles X1 and X2 (FIG. 2) toward the attaching direction dill with the other hand.

Figure 13:
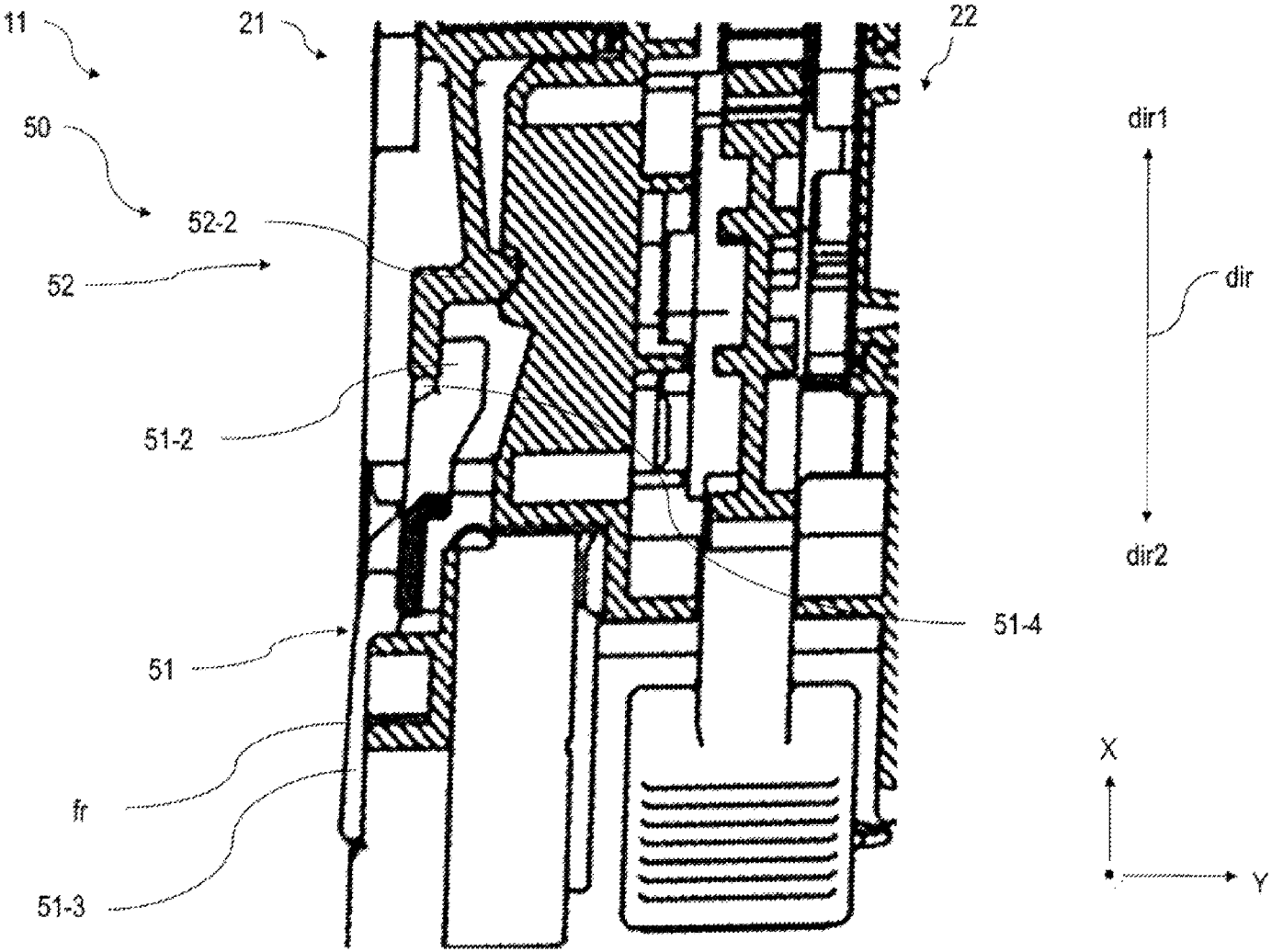
FIG. 13 is a diagram illustrating a cross-sectional view of the lock mechanism 50 and illustrating a process when an outer surface fr of an operation part 51-3 according to an embodiment of the disclosure is pressed with the second pressing force.

FIG. 13 is a diagram of a cross-sectional view of the lock mechanism 50 according to an embodiment, illustrating the progress when the outer surface fr of the operation part 51-3 is pressed by the second pressing force.

The pressing force applied on the outer surface fr of the operation part 51-3 causes the first lever 51 to rotate against the biasing force by the second spring 72 (FIG. 9). Then, as illustrated in FIG. 13, the first protrusion portion 51-2 of the first lever 51 comes in contact with the second lever 52. In the following, the minimum pressing force on the outer surface fr needed to release the first engagement and to make the first protrusion portion 51-2 of the first lever 51 come in contact with the second lever 52 is referred to as a third pressing force. When a pressing force stronger than the third pressing force is applied to the outer surface fr, rotation of the first lever 51 causes the first protrusion portion 51-2 of the first lever 51 to come in contact with the second protrusion portion 52-2 of the second lever 52, and to rotate (swing) the second lever 52.

Note that, as mentioned above, the first protrusion portion 51-2 of the first lever 51 and the second lever 52 are spaced apart from each other by the notch 51-4 of the first lever 51, and in the spaced-apart state, the second engagement is formed. Therefore, the second engagement is not released unless the outer surface fr of operation part 51-3 is pressed by the second pressing force, which is stronger than the third pressing force. Therefore, the development device body 21 and the toner cartridge 22 are not easily detached unintentionally, not only by user operation but also, for example, when an object hits the outer surface fr of the operation part 51-3 and thus a pressing force is applied.

Figure 14:
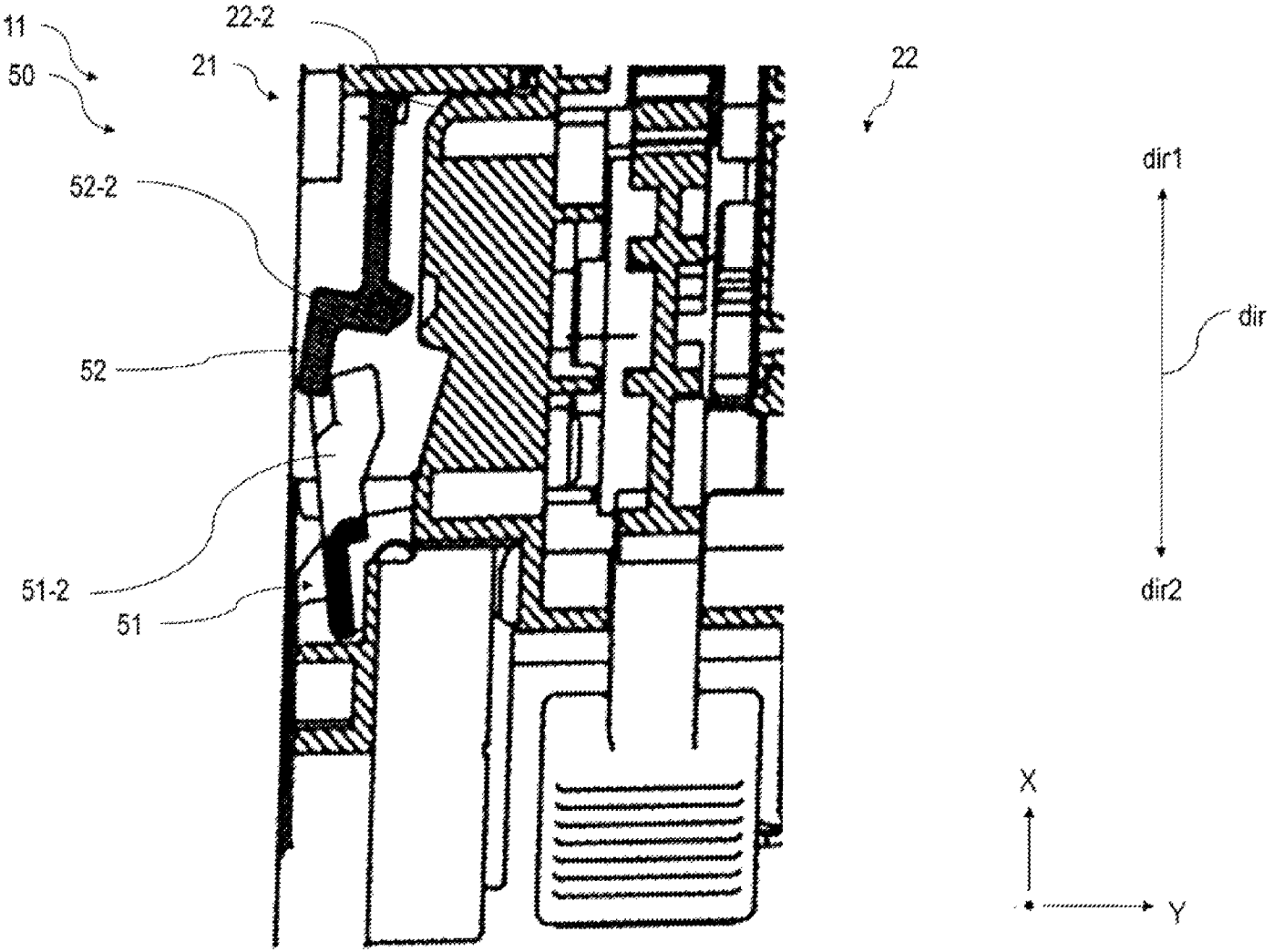
FIG. 14 is a diagram illustrating a cross-sectional view of the lock mechanism 50 in a case where the outer surface fr of the operation part 51-3 according to an embodiment of the disclosure is pressed with the second pressing force.
Figure 15:
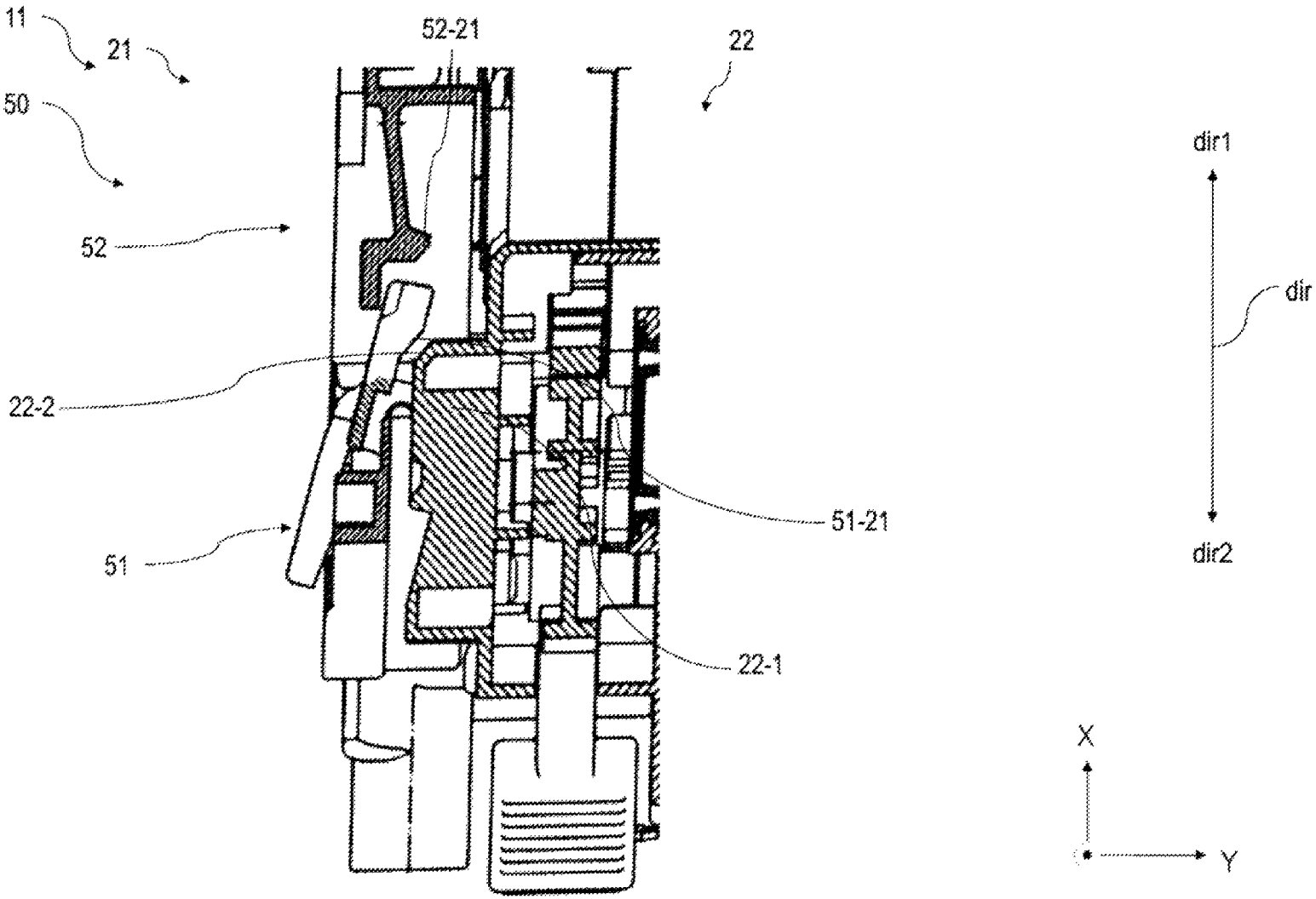
FIG. 15 is a diagram illustrating a cross-sectional view of the lock mechanism 50 immediately after the outer surface fr of the operation part 51-3 according to an embodiment of the disclosure is pressed with the second pressing force.

FIG. 14 is a diagram of a cross-sectional view of the lock mechanism 50 according to an embodiment, illustrating the state where the first engagement and the second engagement are released by the second pressing force pressing the outer surface fr of the operation part 51-3 (FIG. 12), and FIG. 15 is a diagram of a cross-sectional view of the lock mechanism 50 according to an embodiment, Illustrating a state immediately after the first engagement and the second engagement are released by the second pressing force pressing the outer surface fr of the operation part 51-3 (FIG. 12).

When the operation part 51-3 is pressed with the second pressing force, as described above, the force is transmitted from the first protrusion portion 51-2 of the first lever 51 to the second protrusion portion 52-2 of the second lever 52, and the second lever 52 is rotated (deformed) following the rotation of the first lever 51 so as to release the first engagement and the second engagement as illustrated in FIG. 14. When the first engagement and the second engagement are both released as illustrated in FIG. 14, since the toner cartridge 22 is pressed by the first spring 71 (FIG. 4) toward the detaching direction dir2, the toner cartridge 22 pops out toward the detaching direction dir2 as illustrated in FIG. 15. This eliminates the need to pull the toner cartridge 22 while pressing down on the operation part 51-3, making the toner cartridge 22 can be easily detached (disengaged) from the development device body 21.

To the contrary, upon installing (attaching) the toner cartridge 22 to the development device body 21, the state transitions as illustrated in FIGS. 15, 13, and 12 in the recited order. Upon installing the toner cartridge 22 to the development device, an inclined surface 22-2 (FIG. 15) provided on the attaching direction dill side on the attachment/detachment guide 22-1 of the toner cartridge 22 presses an inclined surface 51-21 (FIG. 15) of the first lever 51, to rotate (pivot) the first lever 51 against the pressing force of the second spring 72 (FIG. 9), which prevents the first lever 51 from disturbing the installation of the toner cartridge 22. In addition, as mentioned above, the second lever 52 follows the first lever 51, so the second lever 52 also does not interfere with the installation of the toner cartridge 22. Furthermore, since the inclined surface 52-21 (FIG. 15) is provided on the detaching direction dir2 side of the second lever 52 in such a manner that the inclined surface 52-21 extends toward the inside of the development device body 21 as being closer to the attaching direction dill side, the second lever 52 is less likely to interfere with the installation of the toner cartridge 22.

Figures 16A, 16B, 16C:
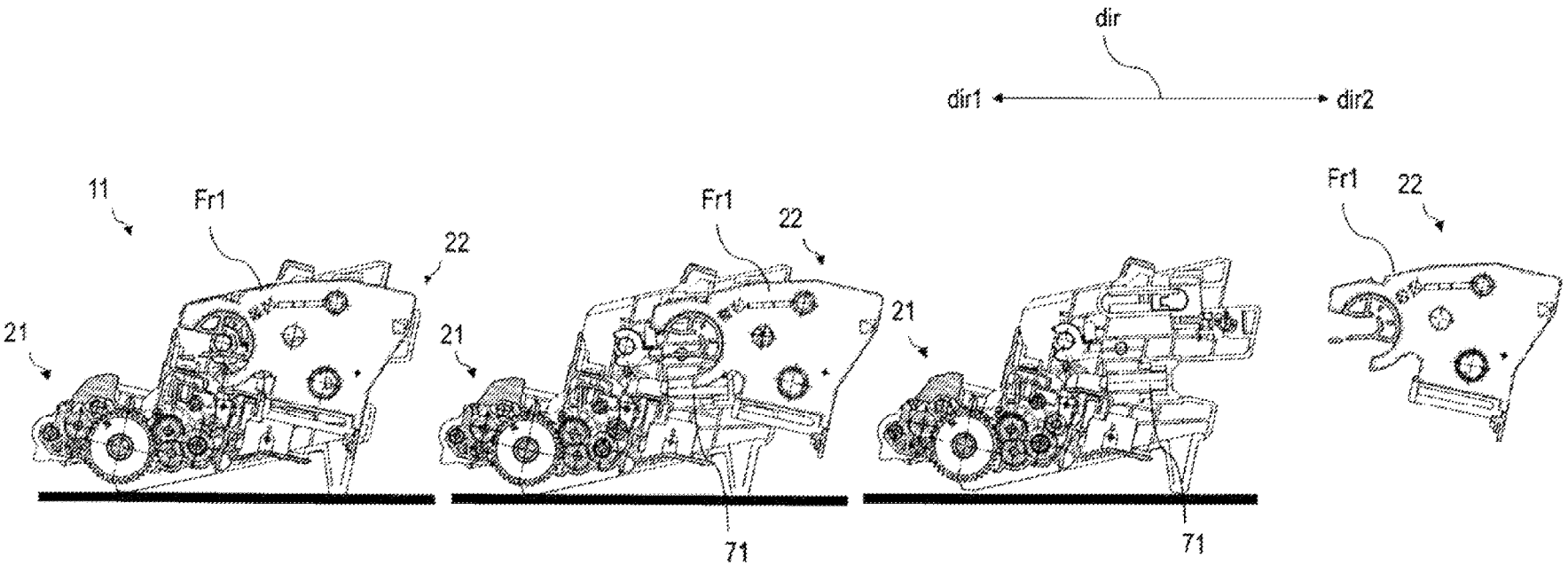
FIGS. 16A to 16C are diagrams illustrating cross-sectional views of the development device 11 in a process of attaching and detaching the toner cartridge 22 according to an embodiment of the disclosure.

FIGS. 16A to 16C are diagrams of cross-sectional views of the development device 11 in the process of attaching and detaching the toner cartridge 22 according to an embodiment. Specifically, FIGS. 16A to 16C are cross-sectional views of the development device 11 taken along the line A-A in FIG. 2B in a case where the development device 11 is detached from the printer 10 and placed on a horizontal surface. FIG. 16A is a cross-sectional view illustrating a state that the shutter member 41-1 is in the closed position by the operation of the shutter lever Lv as described above.

FIG. 16B is a cross-sectional view illustrating a state immediately after the first engagement and the second engagement are released by the second pressing force pressing the operation part 51-3, which corresponds to the state of FIG. 15. FIG. 16C is a diagram illustrating a state where the toner cartridge is detached from the printer (the development device) by a user grabbing and pulling the handles X1 and X2.

In the state illustrated in FIG. 16A, a pressing force is not applied to the outer surface fr of the operation part 51-3 (FIG. 12), so the locking mechanism 50 is in the state illustrated FIG. 12. Therefore, the toner cartridge 22 is positioned with respect to the development device body 21 by the second engagement and is strongly engaged by the first engagement, so that the toner cartridge 22 is not separated from the development device body 21. As described above using FIGS. 10, 11, and 12, when the outer surface fr of the operation part 51-3 (FIG. 12) is pressed with the second pressing force in the state illustrated in FIG. 16A, the first engagement and the second engagement are both released, and the biasing force of the first spring 71 causes the toner cartridge 22 to pop out in the detaching direction as illustrated in FIG. 16B. After that, the user grasps the handles X1 and X2 and pulls out in the detaching direction, the toner cartridge 22 is separated and detached from the development device body 21 as illustrated in FIG. 16C.

To the contrary, when the user moves the toner cartridge 22 the attaching direction dir1 from the state illustrated in FIG. 16C to the state illustrated in FIG. 16B, the first spring 71 comes in contact with the outer frame Fr1 of the toner cartridge 22 in the state illustrated in FIG. 16B. After that, when the user pushes the toner cartridge 22 further in the attaching direction dir1 against the biasing force of the first spring 71, the first spring 71 is compressed and the toner cartridge 22 is installed (attached) to the development device body 21.

Figure 17:
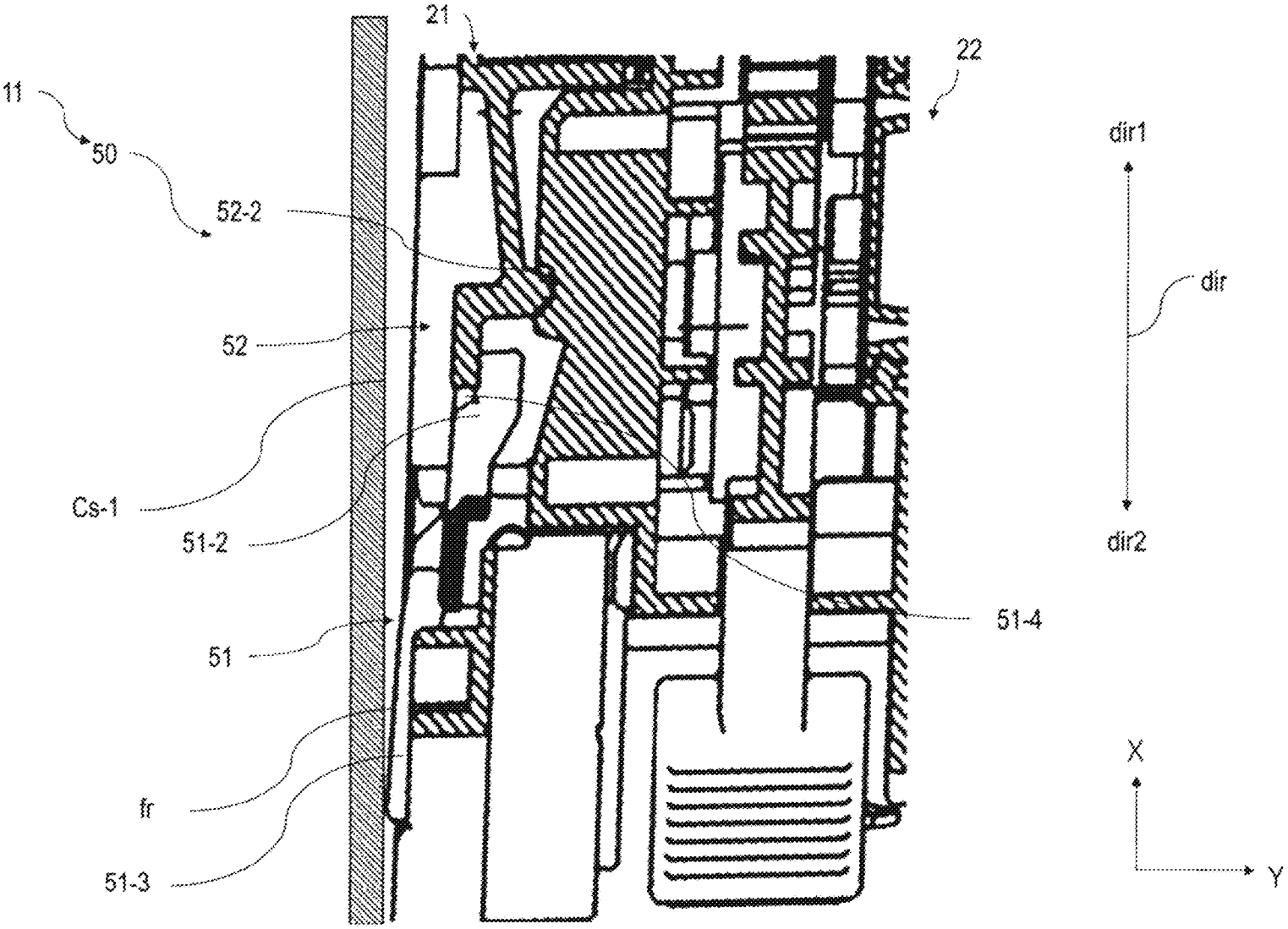
FIG. 17 is a diagram illustrating a cross-sectional view of the development device 11 when attached to the printer 10 according to an embodiment of the disclosure.

FIG. 17 is a diagram of a cross-sectional view of the development device 11 in the state where the development device 11 is attached to the printer 10 according to an embodiment. The housing Cs of the printer 10 (FIG. 1) includes a housing surface Cs-1 that is provided along the side plate SL in the state where the development device 11 is installed. In this state, the operation part 51-3 is pressed by the housing surface Cs-1 with a third pressing force that releases the first engagement. With this configuration, in the state where the development device 11 is installed in the printer 10, the lock mechanism 50 becomes in a state where the first engagement is released and the second engagement is formed.

In one or more embodiments described above, the first engagement is released by the first pressing force that is weaker than the third pressing force. However, in a modification, the thickness of the first lever 51 in the Y-axis direction and the length of the first engaged surface 61-1 may be adjusted (designed) so that the first engagement is released by the third pressing force. Further, in a modification, the housing surface Cs-1 may be provided such that the outer surface fr of the operation part 51-3 is pressed by the first pressing force in the state where the development device 11 is installed in the printer 10. In other words, in a modification, the housing surface Cs-1 may be formed to release the first engagement released while forming the second engagement in the state where the development device 11 is installed in the printer 10.

In a comparative example in which the third engagements secure the position of the toner cartridge 22 with respect to the development device body 21 without having the lock mechanism 50 (without having the first and second engagements), if the shutter lever Lv is not operated correctly, the development device 11 is removed from the printer 10 with insufficient fixation, and after that, there may be a problem that the lock function is insufficient outside the printer 10 so that the development device body 21 and toner cartridge 22 are detached from each other outside the printer 10. Therefore, according to one or more embodiments described above, the lock mechanisms 50 to fix the position of the toner cartridge 22 with respect to the development device body 21 are provided at both ends in the Y-axis direction, respectively. With this configuration, even when the development device 11 is removed to the outside of the printer 10, the lock mechanisms 50 prevents the development device 11 from being separated unintentionally.

Further, according to one or more embodiments described above, in the state where the development device 11 is installed in the printer 10, the toner cartridge 22 can be attached and detached from the development device body 21 with conventional operation without compromising the user's operability. Specifically, in the state where the development device 11 is installed inside the printer, the third engagements are formed by operating the shutter lever Lv. When the toner cartridge 22 is grasped and pulled out in the detaching direction in the state that the toner cartridge 22 and the development device body 21 are fixed in a relative position, the development device 11 is detached from the printer 10. After the detachment, since the pressing force is not applied to the operation part 51-3, the first engagement is formed by the biasing force of the second spring 72 as illustrated in FIG. 9. This means that if the pressing force applied to the outer surface fr of the operation part 51-3 is smaller than the second pressing force, the second engagement is maintained even if the first engagement is released, so that the development device 11 is less likely to be detached unintentionally.

On the other hand, if the toner cartridge 22 is pulled out in the state where the third engagements are released by operating the shutter lever Lv (FIG. 2), the second engagement is released as the toner cartridge 22 is pulled out and only the toner cartridge 22 can be detached from the development device body 21, since the first engagement is released and the engagement force of the second engagement is weaker than the engagement force of the first engagement as mentioned above.

Note that, in one or more embodiments described above, since the first direction (Y-axis direction) is the longitudinal direction of the development device 11 as illustrated in FIG. 2, the lock mechanisms 50 are provided at both ends of the development device 11 in the first direction (the Y-axis direction). However, the disclosure is not limited thereto. For example, in a modification, the lock mechanism may be provided only at one end in the first direction.

Further, in one or more embodiments described above, the case has been described in which the first springs 71 (FIG. 4) are provided at both ends in the Y-axis direction in the development device body 21. However, the disclosure is not limited to thereto. In a modification, the first spring 71 may be placed singly or in plurality in the middle, for example. In a modification, the first spring 71 may be provided on the toner cartridge 22 rather than on the development device body 21. In a modification, the biasing force may be made different depending on the position of the first spring.

In one or more embodiments described above, the case has been described in which the second lever 52 is provided on the side of the attaching direction dir1 with respect to the first lever 51. However, the disclosure is not limited thereto. In a modification, the first lever 51 may be provided on the side of the attaching direction dir1 with respect to the second lever 52.

Note that in one or more embodiments described above, the first spring 71 is serves as a second biasing member and the second spring 72 serves as a first biasing member. In addition, the U-shaped members 41-6L and 41-6R serve as third engagement portions, and the posts 21-1L and 21-1R serve as third engaged portions.

The disclosure is applicable to developer cartridges in image formation apparatus such as printers, copiers, facsimiles, and multifunctional machines.

The invention includes other embodiments or modifications in addition to one or more embodiments and modifications described above without departing from the spirit of the invention. The one or more embodiments and modifications described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A development device comprising:

a development device body including a developer carrier;

a developer cartridge configured to be attachable to and detachable from the development device body;

a first lever and a second lever that are provided to the development device body, wherein the first lever includes an operation part and a first engagement portion and the second lever includes a second engagement portion;

a first engaged portion and a second engaged portion that are provided to the developer cartridge, wherein the first engaged portion is configured to form a first engagement with the first engagement portion of the first lever and the second engaged portion is configured to form a second engagement with the second engagement portion of the second lever; and a first biasing member biasing the first engagement portion to the first engaged portion with a biasing force of the first biasing member, wherein when the operation part of the first lever is operated with a first pressing force, the first engagement is released, and when the operation part is operated with a second pressing force greater than the first pressing force, the first engagement is released and the second engagement is released by the second pressing force being transmitted from the first lever to the second lever.

2. The development device according to claim 1, wherein when the operation part of the first lever is operated with a third pressing force greater than the first pressing force and smaller than the second pressing force, the first lever is moved such that the first engagement portion of the first lever is separated from the first engaged portion and comes in contact with the second engagement portion of the second lever, when the operation part of the first lever is operated with a pressing force smaller than the third pressing force and greater than the first pressing force, the first lever is moved such that the first engagement portion of the first lever is separated from the first engaged portion but does not come in contact with the second engagement portion of the second lever, and when the operation part of the first lever is operated with a pressing force greater than the third pressing force, the first lever is moved such that the first engagement portion of the first lever is separated from the first engaged portion and comes in contact with the second engagement portion of the second lever to thereby move the second lever by the first engagement portion transmitting the pressing force to the second engagement portion.

3. The development device according to claim 1, wherein an engagement force of the first engagement between the first engagement portion and the first engaged portion is greater than an engagement force of the second engagement between the second engagement portion and the second engaged portion.

4. The development device according to claim 1, wherein the first biasing member is configured, in a state where the first engagement is formed, to press the operation part toward an outside of the development device with a first biasing force, the second engagement portion is configured, in a state where the second engagement is formed, to be biased to the second engaged portion with a second biasing force caused by an elastic force of the second lever, and the second biasing force is smaller than the first biasing force.

5. The development device according to claim 1, wherein the first engaged portion includes a first engaged surface that is provided on a side of a detaching direction of the developer cartridge with respect to the first engagement portion of the first lever and faces the first engagement portion of the first lever in the detaching direction in a state where the first engagement and the second engagement are formed, wherein the first engaged surface is configured to come in contact with the first engagement portion to restrict detachment of the developer cartridge from the development device body, the second engaged portion includes a second engaged surface that is provided on the detaching direction side with respect to the second engagement portion of the second lever and faces the second engagement portion of the second lever in the detaching direction in the state where the first engagement and the second engagement are formed, wherein the second engaged surface is configured to come in contact with the second engagement portion to restrict the detachment of the developer cartridge from the development device body, and as seen in a plane defined by an attaching direction of the developer cartridge and a first direction orthogonal to the attaching direction, an angle of the first engaged surface with respect to the first direction is smaller than an angle of the second engaged surface with respect to the first direction.

6. The development device according to claim 5, wherein a length of the first engaged surface in the first direction is shorter than a length of the second engaged surface in the first direction.

7. The development device according to claim 1, wherein the first lever includes the first engagement portion and the operation part such that the first engagement portion is provided at a portion of the first lever on a side in an attaching direction of the developer cartridge and the operation part is provided at a portion of the first lever on a side in a detaching direction of the developer cartridge, and the second lever includes the second engagement portion at a portion of the second lever on the side in the detaching direction.

8. The development device according to claim 1, wherein the development device body includes a support part that is provided on at least one end of the development device body in a first direction orthogonal to an attaching direction of the developer cartridge, the support part extending in a detaching direction of the developer cartridge and holding the first lever and the second lever, the first engagement portion of the first lever is provided on a side of the attaching direction of the developer cartridge with respect to a first swing support portion of the first lever where the first lever is swingably supported by the support part, the second engagement portion is provided on a side of the detaching direction with respect to a second swing support portion of the second lever where the second lever is swingably supported by the support part, and the operation part of the first lever is provided on the side of the detaching direction with respect to the first swing support portion of the first lever, and is projected outward of the development device with respect to the support part with the biasing force of the first biasing member.

9. The development device according to claim 1, further comprising:

a second biasing member provided on at least one of the development device body and the developer cartridge, wherein the second biasing member biases the developer cartridge in a detaching direction of the developer cartridge from the development device body, and a biasing force of the second biasing member is smaller than an engagement force of the second engagement between the second engagement portion and the second engaged portion.

10. An image formation apparatus comprising:

the development device according to claim 1; and a housing of the image formation apparatus in which the development device is installed, wherein the development device body includes a support part extending in a detaching direction opposite to an attaching direction of the developer cartridge and supporting the first lever and the second lever, the housing of the image formation apparatus includes a housing surface provided along the support part, in a state where the development device is installed in the housing of the image formation apparatus, the operation part of the first lever is pressed by the housing surface of the image formation apparatus with the first pressing force.

11. The image formation apparatus according to claim 10, wherein the developer cartridge includes a third engagement portion, the development device body includes a third engaged portion configured to form a third engagement with the third engagement portion, and upon pulling the developer cartridge of the development device installed in the housing of the image formation apparatus in the detaching direction in a state where the third engagement is formed, the development device is detached from the image formation apparatus, and upon pulling the developer cartridge of the development device installed in the housing of the image formation apparatus in the detaching direction in a state where the third engagement is released, the developer cartridge is detached from the image formation apparatus.

12. A development device comprising:

a development device body including a developer carrier;

a developer cartridge configured to be attachable to and detachable from the development device body;

a first lever and a second lever that are provided to the development device body, wherein the first lever includes an operation part and a first engagement portion and the second lever includes a second engagement portion;

a first engaged portion and a second engaged portion that are provided to the developer cartridge, wherein the first engaged portion is configured to form a first engagement with the first engagement portion of the first lever and the second engaged portion is configured to form a second engagement with the second engagement portion of the second lever; and a first biasing member biasing the first engagement portion to the first engaged portion to form the first engagement with a biasing force of the first biasing member, wherein when the operation part of the first lever is operated with a first pressing force, the first lever is moved to separate the first engagement portion away from the first engaged portion to release the first engagement between the first engagement portion and the first engaged portion, and when the operation part is operated with a second pressing force greater than the first pressing force, the first lever is moved to separate the first engagement portion away from the first engaged portion to thereby release the first engagement and cause the first engagement portion to come in contact with the second lever to move the second lever to thereby release the second engagement between the second engagement portion and the second engaged portion.

* * * * *